United States Patent [19]

Cunningham

[11] Patent Number: 4,747,455

[45] Date of Patent: May 31, 1988

[54] HIGH IMPACT DEVICE AND METHOD

[75] Inventor: James D. Cunningham, Boulder, Colo.

[73] Assignee: JBD Corporation, Boulder, Colo.

[21] Appl. No.: 754,637

[22] Filed: Jul. 15, 1985

Related U.S. Application Data

[63] Continuation-in-part of Ser. No. 490,677, May 2, 1983, abandoned.

[51] Int. Cl.[4] ..... B25C 1/06

[52] U.S. Cl. ..... 173/1; 173/53; 173/139; 173/121; 173/124

[58] Field of Search ..... 173/1, 10, 53–55, 173/90–92, 114, 119, 139, 121, 124; 227/5, 6, 8, 129–134, 147, 7, 120

[56] References Cited

U.S. PATENT DOCUMENTS

| | | | |
|---|---|---|---|
| 1,860,826 | 5/1932 | Tschudi | 173/121 |
| 3,640,351 | 2/1972 | Coyne et al. | 173/133 |
| 4,323,127 | 4/1982 | Cunningham | 173/53 |
| 4,484,638 | 11/1984 | West | 173/90 |

FOREIGN PATENT DOCUMENTS

| | | | |
|---|---|---|---|
| 432282 | 8/1975 | U.S.S.R. | 173/92 |

*Primary Examiner*—Donald R. Schran
*Assistant Examiner*—James L. Wolfe
*Attorney, Agent, or Firm*—Edwin L. Spangler, Jr.

[57] ABSTRACT

A high impact device, as for producing an impact of 1,000 foot pounds or more, includes a ram which is engageable by a pair of rotating flywheels. The ram may impact a tool, as of a chisel type adapted for demolition purposes, or having a enlarged head for percussion purposes, or other types or purposes. By terminating the engagement of the flywheels with the ram prior to its impact against a tool or similar object, the vibration normally associated with a demolition or percussion device is avoided. Such termination of engagement also reduces reverse shocks and conserves the energy of the rotating flywheels. In one embodiment, the flywheels are moved inwardly and outwardly of the ram through a linkage connected to a solenoid, with each flywheel supported between a pair of arms and alignment of the axis of each flywheel with the side of the corresponding ram being maintained by a torque tube extending between the arms. A guide for the ram extends into a tool housing, and the ram has an enlargement to engage a hole in an upper plate to limit upward movement and on downward movement to engage a metal ring placed above a pair of resilient rings, for resilieintly terminating downward movement of the ram, if necessary. In another embodiment, one flywheel is fixed, although adjustable laterally, while the other flywheel is pivotally mounted and moved by a hydraulic cylinder with each flywheel being rotated by a hydraulic motor. A heavy coil spring is engaged by the ram on its upward stroke and returns the energy, normally dissipated, to the ram to start it down so that the ram is moving downwardly when engaged by the flywheels. A sensor activated on the upward stroke of the ram may control the inward movement of the movable flywheel while a sensor activated on the downward stroke of the ram may control the withdrawal of the movable flywheel from the ram path. Each sensor control is correlated with the lag time in the movement of the ram from the activating position to a position at which the flywheels should engage the ram and a position when the upper end of the ram is just below the flywheels, respectively.

21 Claims, 13 Drawing Sheets

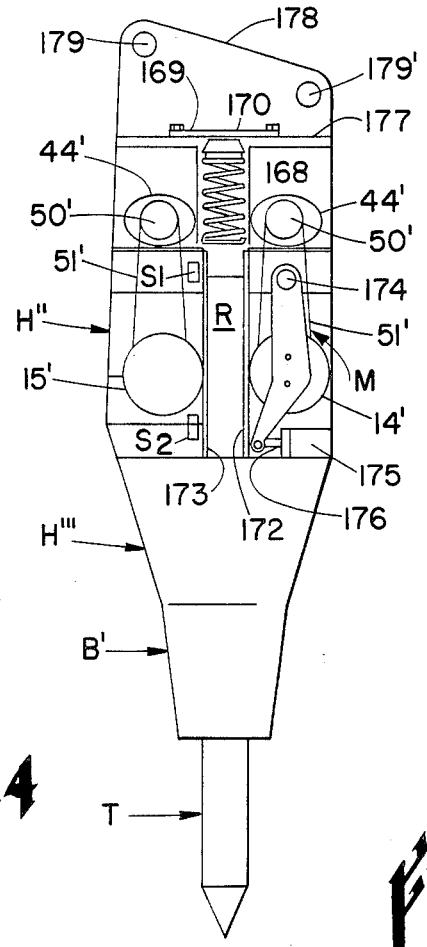
Fig. 14
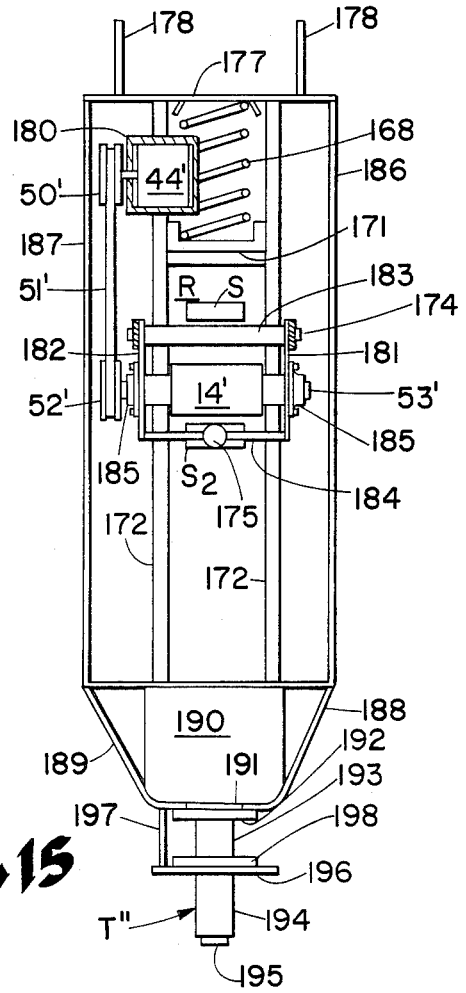
Fig. 15
Fig. 26
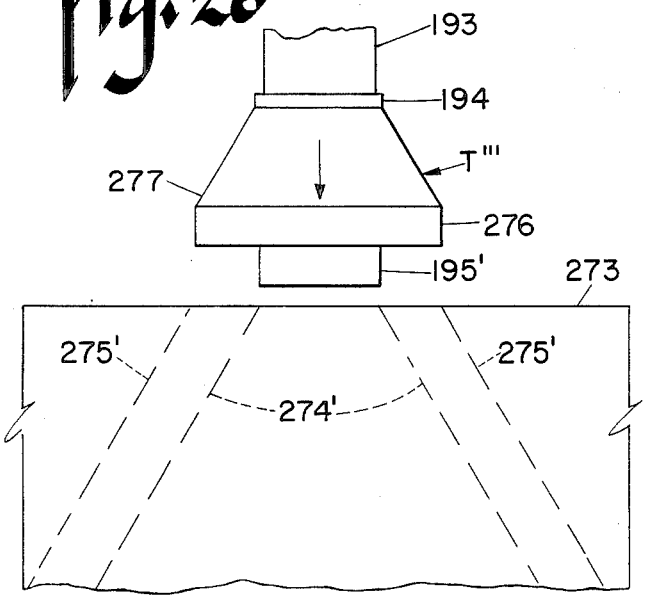
Fig. 25
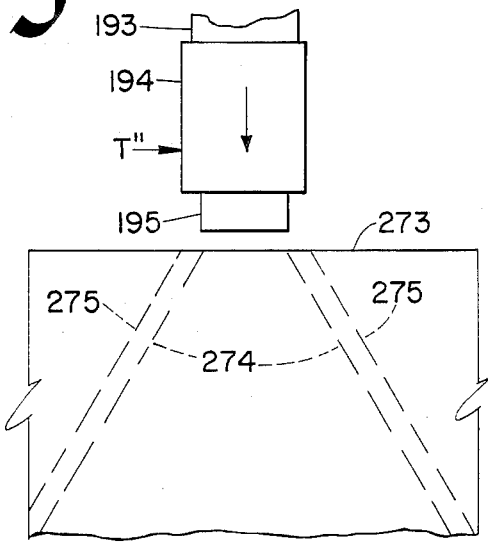

HIGH IMPACT DEVICE AND METHOD

This application is a continuation-in-part of my applicaton Ser. No. 490,677 filed May 2, 1983, now abandoned. This invention relates to apparatus for demolition, percussion and the like and a related method.

BACKGROUND OF THE INVENTION

Demolition devices have commonly utilized compressed air and reciprocating pistons, as in drills or jack hammers used to drill holes in rock, concrete or the like, as for the introduction of an explosive, or blades or the like reciprocated by jack hammers or the like to remove somewhat softer material, such as asphalt paving. Similarly, explosives have been used in the production of sound waves, as for geophysical exploration, by placing in holes drilled in the earth, sometimes to substantial depths, as by small drilling rigs. Devices which are operated by compressed air and used to break up concrete or rocks, involve large amounts of energy and produce vibration and shaking of not only the device itself but also the supporting equipment, as well as an individual operator. Such supporting equipment normally sustains considerable damage, with the result that the cost of maintenance is very high. When vibration absorbing devices have been added to the equipment, such as heavy coil springs, the cost of the same has been unduly high. Also, while the supply of compressed air to the drilling equipment, through hoses, has not involved a particular problem, controls for the equipment, when extended thereto, have involved considerable problems.

Impact devices adapted to drive nails and the like and involving a ram driven by one or two rotating flywheels to impact a series of nails in succession, are represented generally by U.S. Pat. Nos. 4,042,036; 4,121,745; 4,129,240; 4,189,090; 4,204,622; 4,293,493; 4,298,072 and 4,323,127. In each of these devices, which are designed to be hand held, the force required to drive the nail requires that the flywheel or flywheels continue in engagement with the ram, after the nail has been impacted by the ram or by a nail driving tool attached to the ram and until shortly before the nail is completely driven. Also, in order to develop sufficient force to drive the nail, a maximum of kinetic energy must be extracted from the flywheel or flywheels, so that the time required to accelerate the flywheel or flywheels back up to speed limits the time within which impacts against successive nails may be repeated. While the driving of nails produces a certain amount of vibration, the effect is fairly limited, since the number of foot pounds required to drive a nail is on a low order or magnitude, such as 125 foot pounds. However, when a ram is utilized to hit a chisel, for instance, for breaking up rocks of a size which require hoisting equipment to move them and blows in excess of one thousand foot pounds to break them, the reaction produced, if the flywheels continue to engage the ram, after a chisel, for instance, has been hit by the ram, has been found to be equivalent to the vibration produced by reciprocating air driven devices of the jack hammer and air drill types.

Certain features of the impact device of my copending application Ser. No. 407,089 filed Aug. 11, 1982, however, have been found to be useful on heavy duty devices, particularly the discovery that a ram having sides engageable by flywheels for driving purposes, which are formed of a suitable plastic, such as polyurethane, in which a woven natural fiber such as long fiber cotton, is embedded, shows a surprising resistance to wear which has been found also to be present in heavy duty devices of the character described herein.

Among the objects of this invention are to provide a heavy duty device which produces forces in excess of one thousand foot pounds and particularly adapted to be used for demolition, percussion and the like purposes; to provide such a device which is comparatively free from vibration, particularly when compared with the air driven impact devices; to provide such a device which is capable of producing forces of a high magnitude for demolition purposes, such as breaking up reinforced concrete, large rocks and the like; to provide such a device which is readily mountable on a vehicle, so that it may be moved from one place to another and may be readily shifted in position by such a vehicle; to provide such a device which may be effectively controlled and which produces blows, as by a ram, of high magnitude and may be repeated in fractions of a second; to provide such a device which permits a tool, such as a chisel, to be readily replaced when desired; to provide such a device in which a blow against a tool, as by a ram, may be absorbed when the device is accidentally fired without an adequate article or the like in the way of the tool, but the energy of the tool is at least partially absorbed, so that destruction of parts associated with the tool is avoided; to provide such a device which can be used for percussion purposes, such as striking the earth to produce shock waves which are detectable for seismic purposes; to provide such a device which may strike repetitive blows against a tool or the like, which, in turn, strikes an object such as the earth or a rock or the like; to provide such a device which may utilize a special construction in order to maintain the flywheels in exact alignment with the ram, so that neither of the flywheels tends to twist and thereby produce a greater driving effect by one flywheel than by the other; to provide such a device which is particularly adapted to strike a tool, such as a chisel, which requires repeated blows against an object, such as a rock or a reinforced concrete slab, before the tool penetrates the object or shatters portions of the object; to provide such a device which produces a minimum of vibration during use and thereby minimizes damage to a vehicle or other support for the device; to provide such a device in which a relatively heavy spring is placed in a position to absorb the energy of the ram on its return or upward stroke and then return energy to the ram, thereby starting the ram on its downward stroke so that the ram will be moving when engaged by the rotating flywheels; to provide such a device in which the position of the upper end of the ram on its return or upward stroke may be utilized in order to control the movement of at least one flywheel inwardly toward the ram; to provide such a device in which the position of the lower end of the ram on its downward stroke may be utilized to cause the flywheels to withdraw from the ram as soon as the upper end of the ram has moved beyond the flywheels; to provide such a device in which the ram may be protected against accelerated downward movement at a time when the tool to be struck by the ram is not engaging the work which the tool is intended to strike, in order to eliminate abortive blows of the ram which would need to be absorbed by the housing or supporting structure; and to provide such a device which is readily controlled and is efficient and effective in operation.

SUMMARY OF THE INVENTION

A device for demolition, percussion or like purposes, constructed in accordance with this invention, may include a pair of flywheels which are movable laterally inwardly toward the sides of a ram which is driven downwardly when engaged by the flywheels, the ram having an impact head at its lower end which will resist wear due to repetitively striking an upper end of a tool, such as a chisel utilized in breaking up reinforced concrete, rocks and the like, or other type of tool. In accordance with this invention, the relative position of the flywheels, the ram and the tool to be hit by the striking head of the ram is such that the ram is impelled quickly by the flywheels to develop the requisite foot pounds of force, but the upper end of the ram leaves the flywheels before the striking head of the ram hits a tool or the like. This feature results in 'the absence' of vibration produced by the device and particularly the lack of any significant vibration which might be transmitted to the supporting vehicle and tend to destroy parts thereof, as well as parts of the supporting structure for the ram, the flywheels or the tool. A further advantage of such feature is that the flywheels are not in engagement with the ram when the energy of the ram has been dissipated and the ram stopped. Thus, the flywheels are still rotating at a relatively high speed when the ram leaves them and require less time and energy to be accelerated to the desired speed for the next engagement with the ram. The ram is preferably returned to its original position by effective resilient means, such as a pair of resilient cords, normally referred to as bungee cords, which are connected to the ram and thereby are stretched during the downward movement of the ram, but contract and return the ram to its original position after the ram has expended the energy imparted by the flywheels. Since the ram may be moving at a relatively fast speed, such as 25 feet per second, the flywheels must be moved quickly outwardly, to permit the ram to return to its original position without engaging the flywheels. It is significant that the time period during which the flywheels must be moved apart is quite small, as on the order of 10 milliseconds. However, with an adequate control of the spacing between the peripheries of the two flywheels, any impact of the ram against the flywheels on the return stroke of the ram can be avoided. A special but essentially conventional electronic circuit for controlling the flywheels may be utilized for this purpose. Although the flywheels may be moved toward the ram for driving engagement, by a solenoid and links, the forces necessary to hold the flywheels against the ram during driving are such that hydraulic pressure is desirable, as well as being normally available on the type of vehicle on which such a device is most conventionally mounted. However, such a hydraulic pressure is conveniently controlled through an electronic circuit operable to control a solenoid which, in turn, controls a valve which regulates the supply of hydraulic fluid. Also, although the flywheels may be rotated by an electric motor or motors, hydraulic motors may be found to be preferable in view of the availability of hydraulic fluid under pressure on the vehicle. Of course, the vehicle is normally provided with a battery and an alternator for charging the battery, so that current from the battery or alternator is usable for the electronic control circuit.

When it is desired that the energy imparted to the ram before it strikes a tool or the like be increased considerably, the alignment of the flywheels with the ram assumes greater importance. When a flywheel is moved toward and away from the ram, in a short time period, such as 20 milliseconds, the alignment of the flywheels assumes further importance, since any lateral twisting of the flywheels will produce a greater engagement by one edge of the flywheel and a lesser engagement of the opposite edge with the ram, inhibiting the ability of the flywheel to impart maximum energy to the ram. Thus, the flywheels are normally mounted between a pair of arms, pivoted at the base thereof and it is desirable to prevent the arms from twisting laterally about the base thereof. In further accordance with this invention, a torque tube is placed under compression and attached between the lower ends of a pair of arms supporting a flywheel. This torque tube may surround the pivot pin or shaft for the arms, with roller or thrust bearings supporting the arms on the pivot shaft and the latter pivoted in bearings, in turn mounted in brackets. In any event, the torque tube, being attached to as well as clamped between the arms, resists any tendency for the arms to twist, thereby insuring that the full lateral face of the flywheel will engage the ram for driving purposes.

The sides of the ram which are engaged by the flywheels, as indicated, may be formed of woven natural fiber embedded in a suitable plastic. The preferred fiber is long fiber cotton and the preferred plastic is polyurethane, as disclosed in my copending application Ser. No. 407,089 filed Aug. 11, 1982. Although this material is utilized in an impact tool generally designed to drive nails, it has been found to be efficacious for transmitting considerably greater forces. In fact, tests of devices adapted to generate forces of 100,000 foot pounds indicate that a ram which is to be driven to generate one million foot pounds is feasible. The lower portion of the ram may be a solid block of an impact resistant material, such as SAE 4140 steel, since the sides thereof are not engaged by the flywheels. Above this impact head the sides of the ram are provided with the plastic and embedded woven natural fiber layers which have been found resistant to wear, particularly by flywheels having a steel periphery. Desirably, a stem extends longitudinally and centrally of the ram, being integral with the impact resistant head and having some means to secure the molded plastic thereto. Such means may comprise transversely extending, longitudinally spaced ribs, into the spaces between which the plastic extends. An alternative stem construction comprises a series of stems, integral with the lower impact head and each provided with a lateral enlargement at the upper end to provide longitudinal spaces between the stems into which the plastic extends. The edges of the ram move between channel shaped guides, while the flexible cords which return the ram may be attached to each edge of the ram. One method of attachment comprises a longitudinal groove in each edge which is provided with a cross rib having a slot adjacent the lower end below which a knot or other means secures the cord. The edge slots for the cords may extend within plastic down to the striking head, with the lower portion of the longitudinal slots being within the striking head.

The tool which is struck by the ram may be a chisel which is adapted to break up rocks, reinforced concrete and the like, such as having a wedge type point. Another tool may be a percussion tool having a shank similar to a chisel but having an enlarged lower end which is adapted to be placed on the ground prior to being struck by the ram, to produce a shock wave which will travel through the ground and be reflected by underlying strata, thereby being useful for seismic exploration purposes. The shank of either tool may be provided with an enlarged ring in a central longitudinal position, which limits the upward movement of the tool prior to being hit by the ram, to a position which insures that the upper end of the ram will have cleared the flywheels before the lower end hits the tool. For this purpose, the position of the tool above the ring extends through a central circular hole in a guide plate which restricts upward movement of the tool shank by engaging the central ring before the upper end of the tool reaches the critical position. Similarly, a base block, maintained in position by a lower housing or barrel of the unit, provides a hole through which the lower portion of the tool extends and which will limit downward movement of the ring to prevent the upper end of the tool from moving lower than the guide plate above. For instance, if the tool is pushed up the lower barrel by moving the unit downwardly after the lower end of the tool engages the earth, a rock or the like, until the ring engages the guide plate, the upper end of the tool will still be below a position reached by the lower end of the ram, after the upper end of the ram leaves the flywheels. In further accordance with this invention, the base block supports means for dissipating the energy of the ram in the event the ram is, perhaps accidentally, impelled downwardly when there is no rock, or a rock suddenly breaks, concrete, or other object which the tool may hit. Such means surrounds the shank of the tool below the enlarged ring and includes a steel collar and a pair of resilient rings below the steel collar. The steel collar prevents damage to the resilient rings below the steel collar. The steel collar prevents damage to the resilient rings which are adapted to dissipate, as far as possible, the energy imparted to the tool by the ram, thereby saving the parts in which the tool is mounted from undue stress. The resilient rings abut against the base block, which may be provided with a removable portion attached to a removable portion of the barrel, with bolts attaching the removable portion of the base block to the fixed portion of the base block and removable bolts used to attach the guide plate to the barrel, so that the tool can be removed for inspection and replacement, if necessary. The tool, particularly when a chisel, may be provided with a pair of longitudinal flats 90° apart, so that the tool can be maintained, if desired, in a particular lateral position through a corresponding flat at a circular hole in the fixed and removable portions of the base plate and through which the shank of the tool beneath the ring moves. Such a flat may be formed by a guide pin which extends through the base block position and forms a short chord of the circle to abut one of the longitudinal flats on the shank of the tool and to maintain its lateral position.

In another embodiment of the invention, one of the flywheels may be mounted in a relatively fixed position, although adjustable laterally toward or away from the ram, while the opposite flywheel is moved, as by a hydraulic cylinder operating against a pivotal mount for the flywheel, such an actuator conveniently being a double acting hydraulic piston within a cylinder. As before, both flywheels disengage from the ram before the ram strikes the tool or the like, as for demolition, percussion or the like purposes. The speed of such a ram, such as weighing on the order of 50 pounds or more, may be increased by mounting a relatively heavy spring at the top of the stroke of the ram. The ram is pulled upwardly after striking the tool by resilient cords, such as bungee cords, so that the energy of the ram on its upward stroke is absorbed by the spring but returned to the ram when the ram is stopped and thereby not only overcomes the tension of the flexible cords but also produces a faster movement of the ram when engaged by the flywheels. Thus, not only will there be less chance of the flywheels damaging a surface of the ram but also there will be a tendency for the flywheels to suffer a lesser reduction in speed upon initial engagement with the ram, with the production of a higher speed of the ram and therefore a greater impact blow struck by the ram against a tool or the like. The spring also provides a time delay to allow the flywheels to recover from the previous engagement with the ram and thus to reach a higher speed. By appropriately positioning a proximity sensor for the upper edge of the ram, the majority of which is formed of steel, such as the position of the ram upper edge prior to movement against the spring, the sensor utilized to control the movement of one or both flywheels into engagement with the ram, as by a pulse produced by the sensor to control circuit. This position is correlated with the time lag, normally measured in milliseconds, between the actuation of the solenoid which controls the flow of pressurized fluid to a cylinder and piston which move one or both flywheels, as well as the time required for the ram to compress the spring and return from engagement with the spring to the desired position for engagement by the flywheels. Similarly, a second proximity sensor may be placed in a position to respond to the position of the lower edge of the ram, on the downward movement, the impulse produced by this lower ram sensor being utilized to effect a retracting movement of one or both flywheels and thereby cause one or both flywheels to be moved to a spaced position in which the ram will not be engaged by the flywheels on its return stroke. The position of the lower ram sensor, such as below the flywheels, is correlated with the time lag of the hydraulic system to move one or both flywheels away from the ram and the time required for the ram to strike the tool and the upper edge of the ram to return to a position in which the ram would be engaged by the flywheels. A third proximity sensor may be utilized to delay the engagement of the flywheels with the ram if the tool, such as a chisel, is not in an appropriate position to be struck by the ram. Such a sensor may be mounted alongside the upper middle portion of the tool, i.e. chisel, and be responsive to a pin carried by the tool and will actuate the proximity sensor in the event the tool is above a certain position, indicating that the tool is resting on an object to which a blow is to be struck by the tool. This tool sensor may be utilized to initiate striking movement of the ram when the tool is in position to be struck, or to delay movement of the ram when the tool is not in position to be struck. When using a fluid piston and cylinder actuator for moving one or both flywheels toward and away from the position of the ram, an accumulator is placed in the supply line to the hydraulic control valve so that the pressure of fluid supplied to the control valve, for actuation of the cylinder piston to move the flywheel or flywheels toward the ram, may be initially increased. The pump can charge the accumulator during the recovery cycle of the flywheels and thereby provide a faster movement of a flywheel or flywheels toward the ram on the ensuing stroke of the ram.

One method of this invention is to reduce reverse shocks to the rotating flywheel means and includes causing the rotating flywheel means to engage the ram to drive the ram toward an object, such as a tool against which the ram is to produce a relatively heavy impact, but discontinuing the engagement of the flywheel means with the ram prior to the ram striking such object. A further method of this invention is to accomplish conservation of the stored energy of the rotating flywheel means, which includes causing the flywheel means to disengage from the ram prior to the ram striking an object, such as a tool, to produce an impact. This method further includes retracting the ram after it strikes the object and supply rotational energy to the flywheel means prior to and during engagement of the flywheel means with the ram, as well as after disengagement and during retraction of the ram. The stored energy of the flywheel means is thereby increased to a desired value during a shorter period of time, which can be advantageous when increased rapidity of impacts is desirable.

THE DRAWINGS

FIG. 1 is a side elevation of an impact tool of this invention, supportable by mounting means which may be attached to a vehicle or the like and also shown in position to provide impacts on a chisel for breaking rock or the like.

FIG. 14 is a partially diagrammatic front elevation of an additional embodiment of this invention, with cover plates of the upper portion of the housing removed to show the parts in the interior.

FIG. 15 is a side elevation taken at 90° to FIG. 14, not only with the cover plates removed but also with certain parts broken away.

FIG. 25 is a diagram of the action of a demolition tool of this invention on a reinforced concrete slab.

FIG. 26 is a diagram similar to FIG. 25, but showing an action of a modification of the demolition tool.

DESCRIPTION OF THE PREFERRED EMBODIMENT

Figure 1:
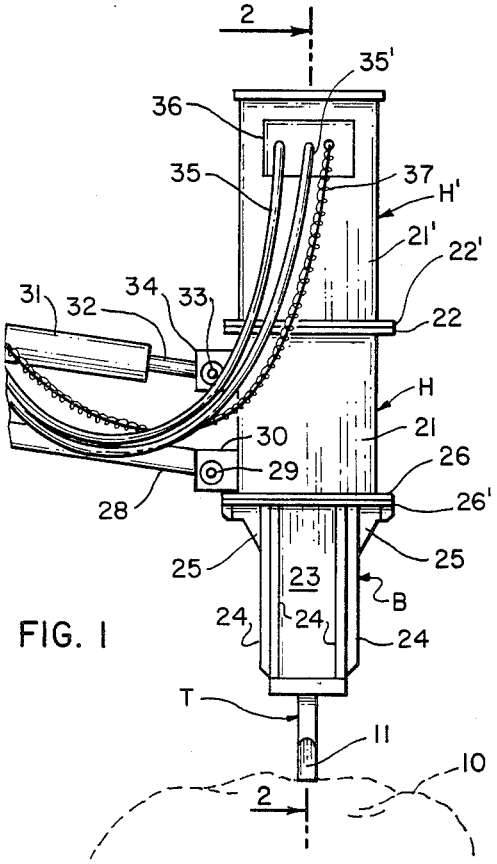
Figure 2:
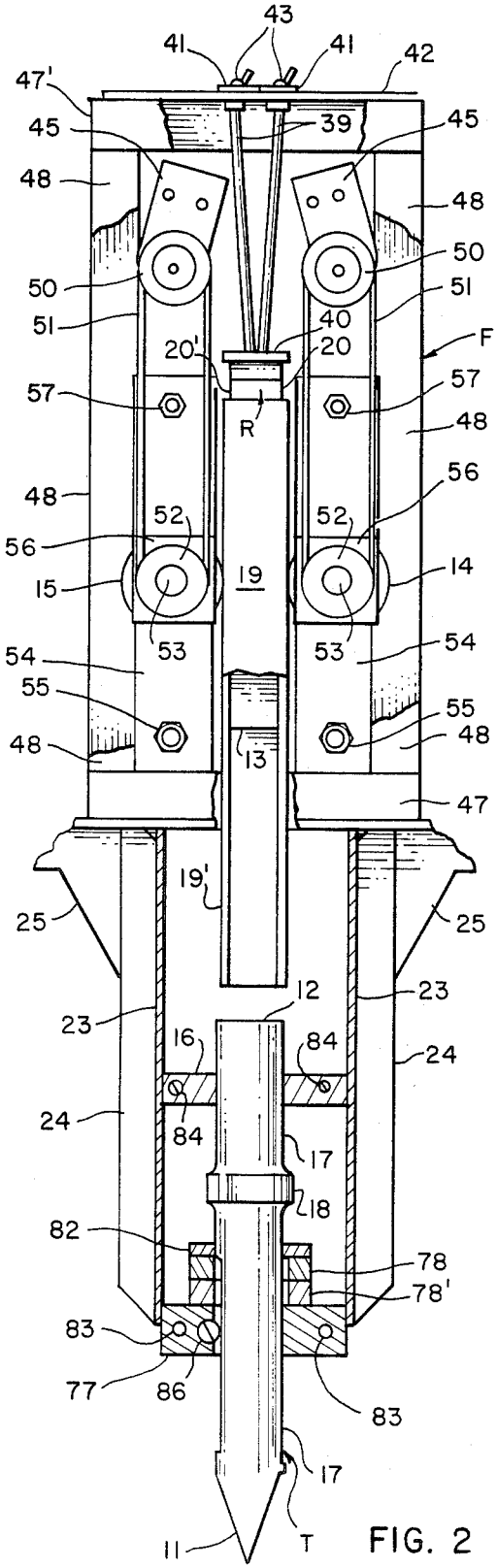
FIG. 2 is a side elevation of an upper portion of the tool of FIG. 1, with an outside cover plate removed to show interior parts, combined with a vertical section of the lower portion, taken along line 2—2 of FIG. 1.

A high energy, low recoil, demolition and percussion device of this invention, as for demolition of a large rock 10 of FIG. 1, may include a tool bit T, such as a chisel having a point 11 placed on the rock preparatory to blows struck against the upper end 12 of the chisel by a lower, impact head 13 of a ram R, which is driven downwardly by oppositely rotating flywheels 14 and 15 of FIG. 2. In accordance with this invention, the uppermost position of the tool bit T, shown in FIG. 2, is determined by an appropriate stop, such as a fixed guide and stop plate 16, through a central hole in which shank 17 of the tool bit T moves and upward movement of which is terminated upon engagement of an enlarged ring 18 on shank 17 with the area of plate 16 around its central hole. Such a stop is spaced a sufficient distance below the flywheels 14 and 15, as below the lower ends of guides 19 and 19' for the ram, that the upper ends of the ram sides 20 and 20', engaged by the flywheels, have moved below the flywheels when the impact head 13 of the ram hits the upper end 12 of tool bit T. It is essential, in an impact device for driving nails, as in U.S. Pat. Nos. 4,042,036 and 4,323,127, for the flywheels to continue to drive the ram by engagement therewith, while a nail is being driven. However, it has been unexpectedly found that when much greater forces are involved, in a demolition device, such as adapted to break concrete two feet thick, for instance, or granite rocks three feet thick by a medium size demolition device, that the vibration and shaking of all parts, characteristic of devices such as jack hammers and the like, may be substantially eliminated by this feature of the invention. Such vibration has resulted in breakage or undue wear of parts, particularly of those parts supporting a demolition or percussion device adapted to deliver blows of the magnitude involved here.

A further advantage of this feature is that, although the speed of each flywheel is reduced somewhat by propelling the ram during the time period each flywheel is in contact with the ram, the rotational speed of either flywheel is not further reduced while the ram is slowed to a halt, such as when driving a nail, but the reduction in speed is limited to that produced by the actual contact, during all of which time the ram is being accelerated. Thus, a drive motor can accelerate the flywheel back up to the desired speed in a much shorter period of time.

The device includes a lower housing H, of FIG. 1, to which supporting parts are attached, and to which is connected an upper housing H'. Housing H and H' enclose a frame F of FIG. 2, in which the flywheels and associated parts are installed, while connected and depending from housing H is a lower barrel B in which the tool bit chisel is guided and struck by the ram, the lower portion of which moves from the frame F into the barrel B and back again. The housings H and H' may be rectangular or square in cross section, covered by side plates 21 and 21', respectively, and connected by flanges 22 and 22', while the similar barrel B is provided with side plates 23, as well as a series of reinforcing ribs 24 and gussets 25, being connected to housing H by flanges 26 and 26'.

The device may be supported in a suitable manner, as in a stationary position, with provisions for lowering and raising the device when the demolition or percussion blows are to be produced at one point, such as when the objects to be broken up or otherwise acted upon, are brought to a point beneath the tool bit T. However, it is more convenient to be able to move the device around, from one position to another, as well as to be able to produce an angularity in the position of the tool bit, in addition to being able to raise and lower the device. Thus, the device may be supported by a vehicle, such as a truck or tractor, as from an arm 28 which is movable upwardly and downwardly, as well as laterally, and is pivotally attached, by a pin 29, to a bracket 30, in turn attached to a side plate of housing H. The arm 28 may be raised and lowered, or moved from side to side by a suitable mechanism on the vehicle, such as hydraulic. In order to maintain the device in an upright position, or to tip the device to a number of different angular positions, relative to the vertical, a hydraulic cylinder 31 is suitably mounted on the vehicle, or pivotally mounted on the arm 28, so that it may assume a normal position generally parallel to the arm. Hydraulic cylinder 31 is provided with a piston rod 32 which is attached by a pivot pin 33 to a bracket 34, in turn mounted on a side plate of the housing H. Although FIG. 1 indicates a side mount, the vehicle mechanism can be connected to the top of the device. A pair of hydraulic hoses 35 and 35', one normally for supplying hydraulic fluid under pressure to the device and the other for returning exhaust fluid to a sump or tank on the venhicle, may extend into housing H', through a plate 36, for suitable connection to parts within the device. An electrical cable 37, carrying both power wires and control wires, and conveniently reinforced by a surrounding spring wire coil, as shown, may also extend from the vehicle to the housing H', through plate 36.

Figure 3:
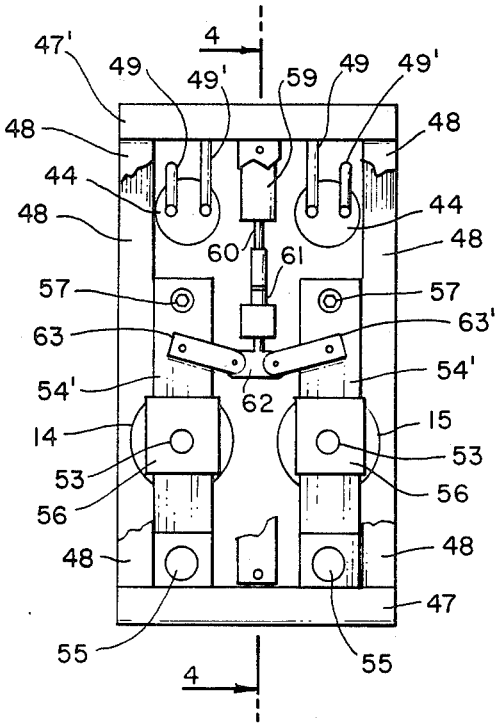
FIG. 3 is an opposite side elevation, similar to the upper portion shown in FIG. 2 but on a smaller scale and with certain parts broken away for clarity.
Figure 4:
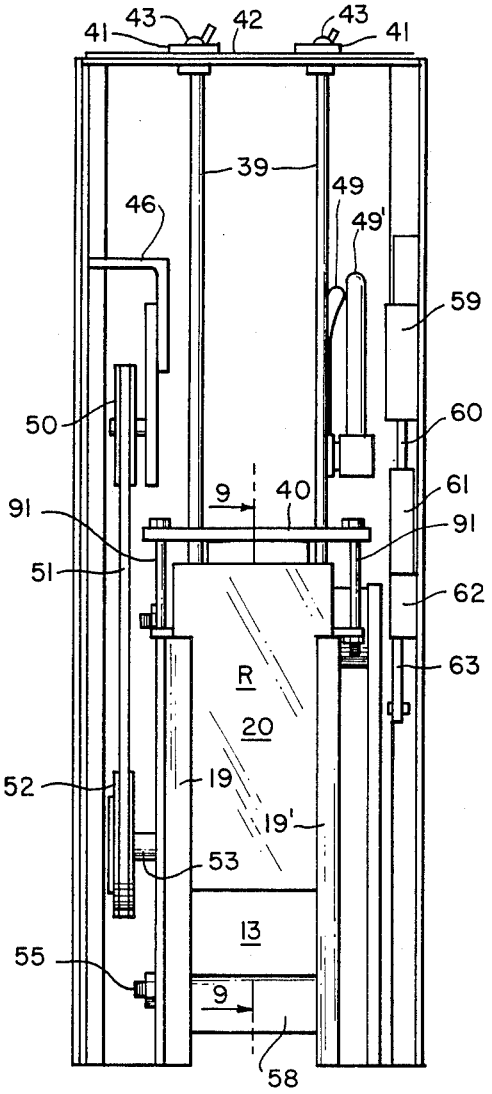
FIG. 4 is a vertical section taken along line 4—4 of FIG. 3, on an enlarged scale.

The ram R is returned from its lower position, after impact against the upper end of tool bit T, by multiple pairs of bungee cords 39, each of which, as in FIG. 4, extends upwardly from the ram through a ram return stop plate 40 into a bungee cord knot grip 41, which retains the upper end of each cord at a top plate 42 of the housing H', by gripping a knot 43 at the upper end of the corresponding cord. The upward travel of ram R is terminated by the ram return stop plate 40 mounted on the upper ends of guide channels 19 and 19'. A pair of hydraulic motors 44 of FIG. 3 are mounted in housing H' at laterally spaced positions, by motor mounts 45 of FIG. 2, depending from a plate 46 attached to one of a set of upper cross bars 47 of frame F, which also includes a set of lower cross bars 47' and a series of corner angles 48 and 48' which extend between the lower cross bars 47' and the upper cross bars 47. Each hydraulic motor 44, as in FIG. 2, is supplied by a hydraulic branch line 49 which is connected to hydraulic hose 35, while a hydraulic branch line 49' leads from the respective hydraulic motor to hose 35', for returning hydraulic fluid after flow through the respective hydraulic motor. For rotating the flywheels 14 and 15, a pulley 50 is driven by each of the hydraulic motors 44, while a belt 51 connects each pulley 50 with a pulley 52 mounted on the corresponding flywheel shaft 53. A pair of supporting bars 54 of FIG. 2 and opposed bars 54', of FIG. 3, for each flywheel, extend upwardly from a pivot bolt 55 past a bearing retainer 56 mounted on each support bar 54' on one side of the housing H, as in FIG. 2, and a corresponding bearing retainer 56', on the opposite support bar 54', as in FIG. 3. The upper ends of the support bars 54 and 54' are secured together by a bolt 57. In the embodiment of FIGS. 1–5, a tube 58 surrounds pivot bolt 55 at the bottom, to resist the clamping pressure of the bolt, while a similar tube 58' surrounds upper bolt 57.

The flywheels 14 and 15, as in FIGS. 3 and 4, are moved toward and away from the sides of the ram R through a suitable mechanism, such as a hydraulic cylinder or solenoid 59, mounted centrally at the top of the housing H' between the hydraulic motors 44. A reciprocating plunger 60 of hydraulic cylinder or solenoid 59 is provided with a length adjustment 61 which extends to a T-shaped connector 62. A link 63 is pivoted on connector 62 and support bars 54' for flywheel 14, while a link 63' is pivoted on connector 62 and the support bar 54' for flywheel 15, each on a pin 64.

Figure 5:
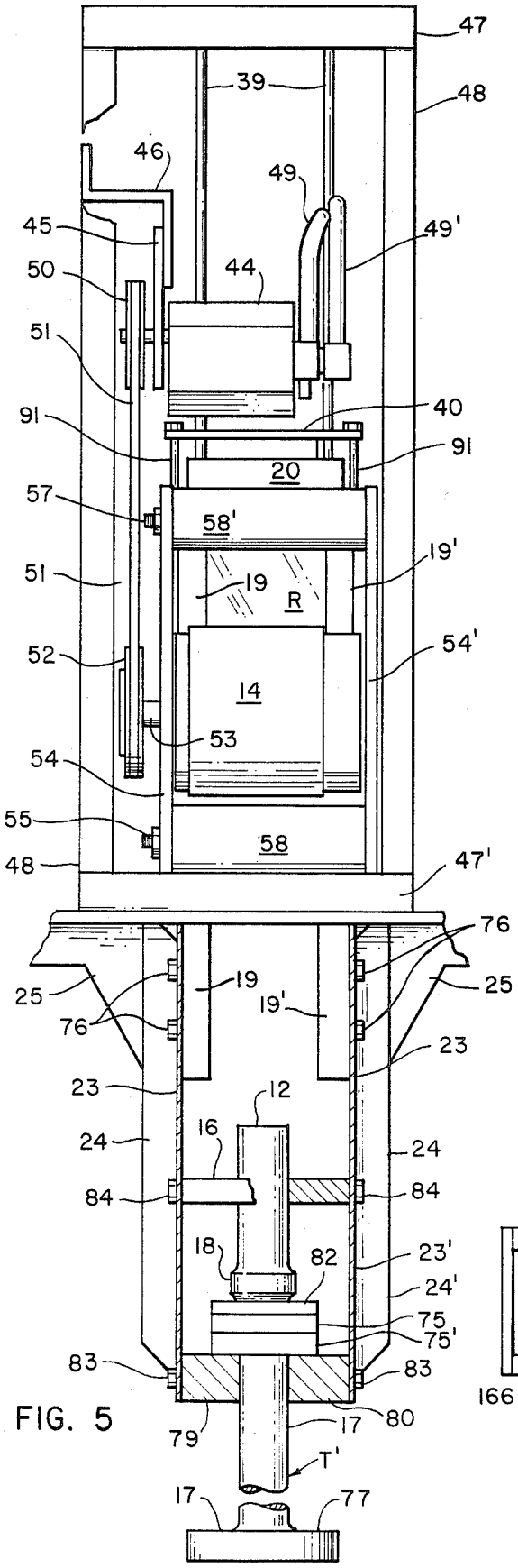
FIG. 5 is a combination of a side elevation of an upper portion of the tool shown in FIG. 2 and similar but taken at a right angle thereto, with a corresponding vertical section of the lower portion of FIG. 2.
Figure 6:
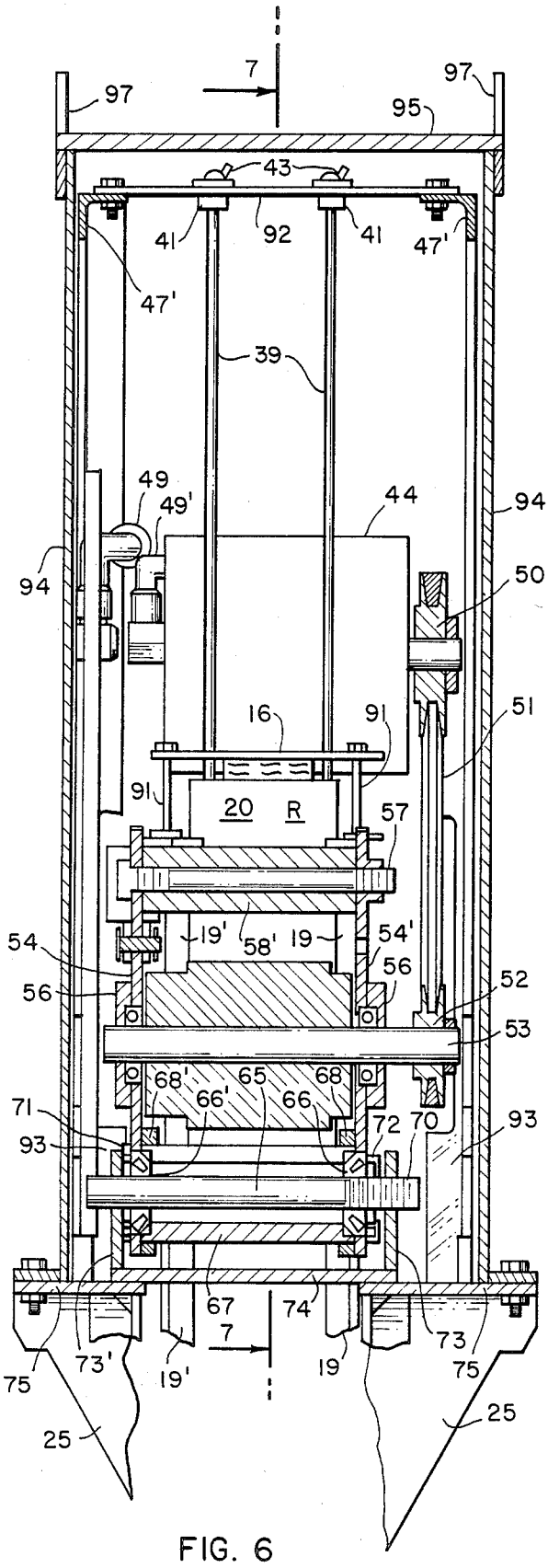
FIG. 6 is a vertical section of an upper portion of a modification of the tool of FIG. 1, taken along offset line 6—6 of FIG. 7.
Figure 7:
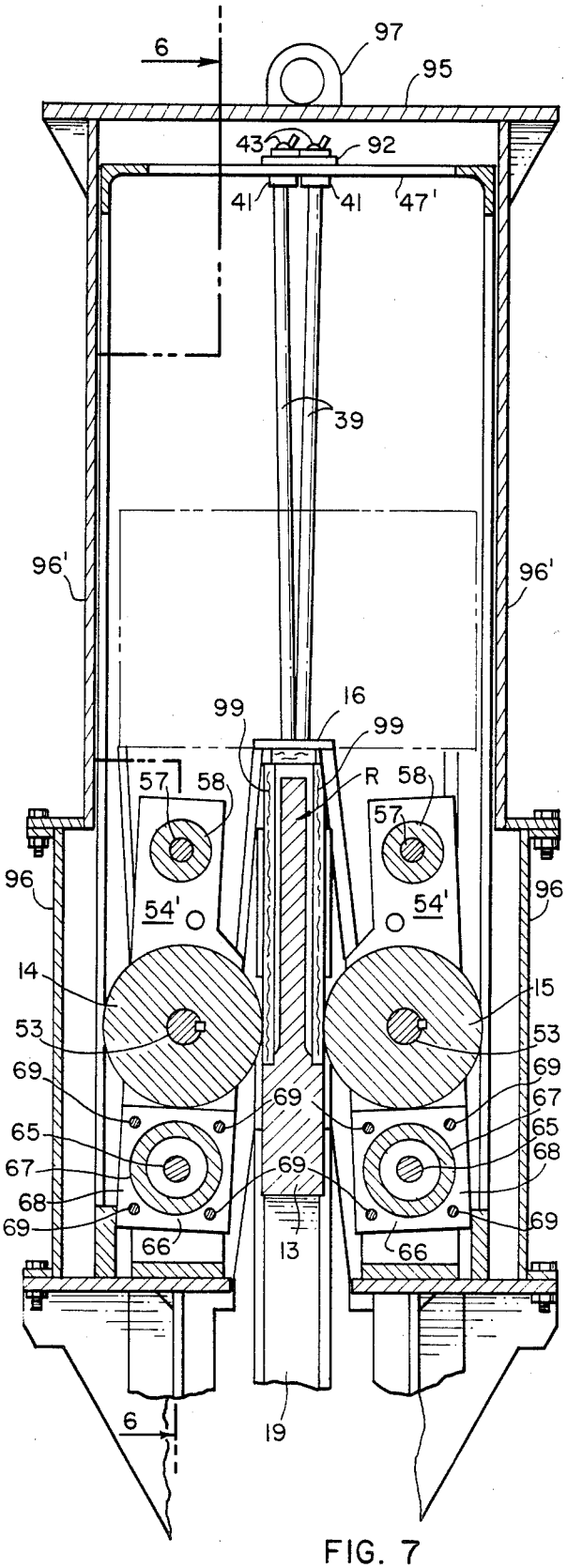
FIG. 7 is a similar vertical section taken along line 7—7 of FIG. 6.

In accordance with a further improvement of this invention, each flywheel assembly, as in FIGS. 6 and 7, is stabilized so as to resist torsional stresses and prevent either flywheel 14 or 15 from twisting toward one side or the other and thereby reduce the driving force imparted to the corresponding side 20 or 20' of ram R. The improved embodiment of FIGS. 6 and 7 thus differs from that of FIGS. 1–5 in this respect, the flywheel support bars 54 and 54' being pivoted on a pin 65 by thrust bearings 66 and 66', which are received in counterbores in each end of a torque tube 67, which surrounds the pivot pin 65. Each end of the torque tube is attached, as by welding, to a square plate 68 or 68' which is, in turn, attached, as by a series of rods 69, one at each corner, to the inside of the corresponding arms 54 or 54'. Clamping pressure on torque tube 65 is exerted by rods 69, while additional pressure is exerted by the thrust bearings. Bearing 66 is threaded on the inside to engage threads 70 on one end of bolt 65 and bearing 66' abuts a ring 71 mounted on pin 65, as by welding. A nut 72 engages threads 70 outside bearing 66, to exert additional clamping pressure against the torque tube. Each torque tube 65 resists any tendency for either support bar 54 or 54' to twist more or less than the other support bar, thereby retaining the lateral alignment of flywheels 14 and 15 parallel to the sides 20 and 20' of the ram R. Pivot pin 65 for each flywheel is mounted between upright brackets 73 and 73', with threads 70 engaging a threaded hole in bracket 73 and the opposite end of pin 65 extending through a hole in bracket 73'. Brackets 73 and 73' are respectively integral with and removably attached to a mounting plate 74, in turn attached to a top plate 75 of barrel B. Plate 75 is provided with an appropriate aperture through which guide channels 19 and 19' for ram R extend into the barrel B, for attachment to the inside of opposite side plates 23 of the barrel, as by cap screws 76 of FIG. 5. Mounting plates 74 are disposed on opposite sides of this opening, as in FIG. 7. At the upper end of each pair of supports 54 and 54', a reinforcing tube 58' surrounds each bolt 57, similar to FIG. 4, to stabilize the construction and to resist the clamping action of bolt 57.

An alternative construction of the parts associated with torque tube 67 may be utilized, in which the bearings 66 and 66' are secured within circular apertures, in brackets 73 and 73', with the inner race of each bearing being attached to pivot pin 65, which pivots with the bearing inner race. Flywheel support arms 54 and 54' are attached directly to the pivot pin 65 and reinforced by square plates 68 which are attached to the ends of the torque tube 67. Again the rods 69 may produce clamping pressure on the torque tube, extending through both the plates 68 and the arms 54 and 54'. Thus, the torque tube again resists any tendency for either support bar 54 or 54' to twist away from a position parallel to the other support bar, thereby maintaining the periphery of each flywheel parallel to the corresponding side of the ram. It will be understood that the forces on the support bars 54 and 54' include torsional and precession forces generated by the speed of the flywheels and the drive for each flywheel at the pulley 52 at one end of the flywheel shaft 53.

Figure 8:
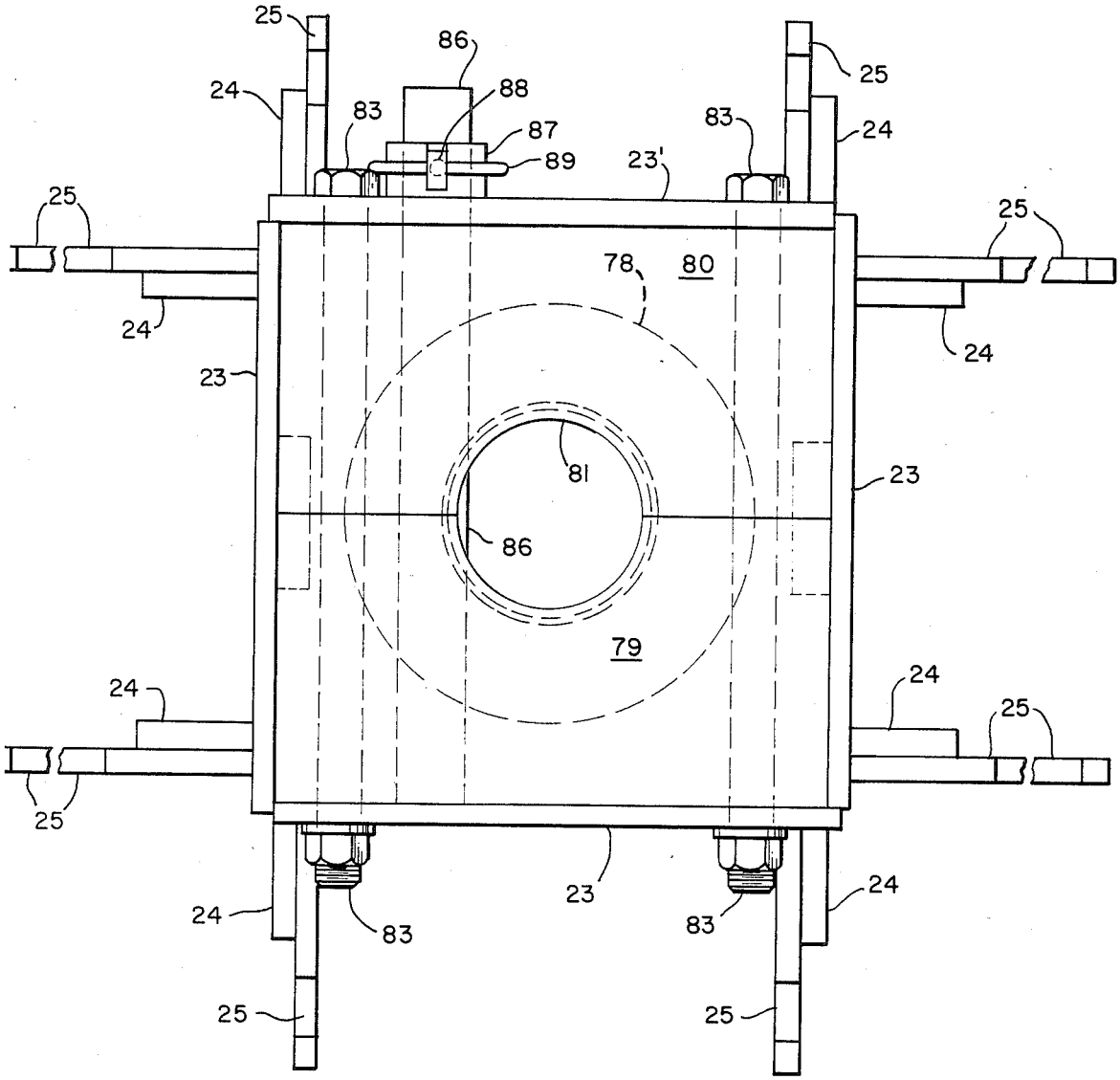
FIG. 8 is a bottom plan view, on an enlarged scale, of the lower end of the device, with a tool being omitted.

It has been found that tool bit T resists the stresses of breaking rock and the like more adequately when formed of a nickel steel, particularly 4340, while tool bit T' of FIG. 5 may be formed of the same material, although the stresses on it may not be as severe as those on tool bit T. The lower end of tool bit T' is provided with a heavy disc 77 which may be circular, oval, square, octagonal or have any other number of sides or shape. Disc 77 is adapted to rest on the earth's surface and strike a percussion blow against it to produce a shock wave traveling through the earth for seismic purposes. When the device is equipped with tool bit T', it may be used for seismic purposes in areas where the detonation of explosives would be objectionable to wildlife, the surrounding population or the terrain. The tool bit T' can be used at the earth's surface or in very shallow holes, compared with the depth of holes usually utilized in setting off explosives for more conventional seismic exploration. The difference between tool bit T and tool bit T' is the point 11 of tool bit T and the disc 77 of tool bit T', since the shank 17 of each is similar, having an enlarged ring 18 and an upper end 12 adapted to be struck by ram R. As before, the purpose of the ring 18 is to stop the tool bit from moving upwardly when it engages a similar guide plate 16, as when moving the device downwardly to place the tool bit T of FIG. 1 in position for a demolition blow against a rock or the like, or a percussive blow of tool bit T' of FIG. 5 against the earth's surface, or in a shallow hole therein. Also, the ring 18, in each instance, acts to prevent the tool bit from falling out of the barrel B, as well as to transfer the force of an accidental impact when the device may be above the earth or a rock, or a rock splits suddenly, and further movement of the tool bit is not resisted to an appreciable extent. Such force is transferred to one or more resilient rings 78 and 78' which abut against a base block 79 of barrel B, having a normally fixed but removable portion 80, as in FIG. 8, and which with base block 79 have a configuration so as to form, between them, a central hole 81 through which shank 17 of the tool bit moves. To prevent undue wear of the resilient rings, enlarged ring 18 of the tool bit strikes a ring 82 of steel, which is superimposed on resilient rings 78 and 78' and with each of the rings encircling the tool bit shank 17. Resilient rings 78 and 78' may be of rubber, flexible plastic or other material adapted to dissipate the impact forces through compression. The compressible rings 78 and 78' transmit the unabsorbed force to the base block 79 and its normally fixed but removable portion 80 which is made removable, as well as guide plate 16 with it, to facilitate changing of the bit T or T'. Base block 79 is welded securely on three sides to plates 23, while removable portion 80 is welded to the lower portion 23' of the fourth plate. Portion 23' extends upwardly past guide plate 16, as in FIG. 5, with a lower portion 24' of each rib being attached, as by welding, to the removable plate portion 23'. The upper portion of rib 24 is attached to the upper portion 23 of the side plate, which is also welded to the upper portions of adjacent plates 23. Portion 80 is removably attached to base plate 79 by a pair of bolts 83, which extend through both and may be removed to remove portion 80 and the attached side plate portion 23' with it. Guide plate 16 is also attached between side plate lower portion 23' and the opposite side plate 23, by similar bolts 84, shown in section in FIG. 2 and in full in FIG. 5. Bolts 84 must also be removed when bolts 83 are removed in order to remove bit T or T' and the rings 78, 78' and 82 with it. Upon removal of portion 80, the bit is free thereof, so that the upper end of the bit may be slid out of guide plate 16. As will be evident, rings 78, 78' and 82 may be slipped off the chisel end of tool bit T but must remain on tool bit T' until cut off. Steel ring 82 on tool bit T' will normally not require replacement, but resilient rings 78 and 78' may be cut off Tool bit T' andremolded in situ on shank 17, if replacement becomes necessary. It is noted that the inner diameter of resilient rings 78 and 78', as in FIG. 2, is greater than the diameter of shank 17, to prevent undue wear against the shank when the resilient rings are compressed and flatten out. This clearance facilitates molding the rings in situ on the shank of tool bit T', since they may be placed there initially in that manner. Steel ring 82 may be placed on the shank after disc 77 has been produced, as by forging, but before enlarged ring 18 has been produced.

The tool bits T and T' are also provided with a pair of flats 85 of FIGS. 2 and 5, which are 90° apart and which may be utilized to maintain tool bit T, particularly, in a radial psoition in which the point 11 is maintained in one desired plane or in a desired plane at 90° thereto. Either flat is engageable by a guide pin 86 which extends through a collar 87 of FIG. 8 attached to side plate portion 23' and into aligned holes in portion 78 and base 77. These holes are located, with respect to circular hole 81, so that one side edge of pin 86 forms a short chord of a small arc of circular hole 81 and therefore abuts whichever flat 85 is in position to engage the pin. Guide pin 86 is provided with a transverse hole adapted to be engaged by a locking pin whose head 88 is normally held against collar 87 by a circular spring 89 which encircles the collar. Guide pin 86 may be readily removed by withdrawing the locking pin against the pull of spring 89, in order to remove guide pin 86 when the bit is to be changed.

The ram stop plate 40 is supported above ram guides 19 and 19' by rods 91 of FIGS. 5 and 6, while in FIGS. 6 and 7 the upper ends of bungee cords 39 are suspended by knot grips 41 from a cross bar 92 mounted on upper angles 47' of a framework similar to framework F of FIG. 2, except that the base is formed of thicker bars 93. The housing of FIGS. 6 and 7 includes plates 94 on two opposed sides which extend upwardly from barrel top plate 75' to a plate 95 at the top of the structure. On the other two opposite sides, lower plates 96 are spaced apart a greater distance than upper plates 96', which extend upwardly to top plate 95 and to whose lower flanges lower plates 96 extend upwardly. These upper ends of lower plates 96 correspond to the upper ends of flywheel support bars. Side plates 96 are spaced apart a greater distance to accommodate heavier, larger diameter flywheels and/or a heavier, thicker ram, if a higher production of energy for the blows of the tool bit T or T' is desired. At its upper end, centrally of side plates 94, a pair of eyes 97 are welded for the purpose of enabling the unit to be handled by a crane or other type of hoist, as when mounting it on or removing it from a vehicle or for other purposes.

A method of this invention for reducing reverse shocks to the rotating flywheels includes not only causing the rotating flywheels to engage the ram to drive the ram toward an object against which the ram is to produce a relatively heavy impact, but discontinuing the engagement of the flywheels with the ram prior to the ram striking the object. Normally, of course, the object struck by the ram is the tool which is used to accomplish the demolition, percussion or the like purpose.

Another method of this invention is that of conserving the stored energy of the rotating flywheels, so that on the next stroke of the ram, the time required to impart the desired energy to the flywheels, i.e. to bring them up to the desired speed, will be considerably less. When the rapidity of impacts or blows is desirable, this method of conserving the energy of the flywheels may be found to be highly advantageous. If the flywheels continue in engagement with the ram when the ram is suddenly stopped by an impact, the flywheels will lose a considerable amount of stored energy. This purpose is accomplished by causing the flywheels to disengage from the ram, prior to the ram delivering the impact. The ram is retracted after it delivers the impact, while rotational energy is supplied to the flywheels, not only prior to and during engagement of the flywheels with the ram, but also after disengagement and during retraction of the ram.

Figure 9:
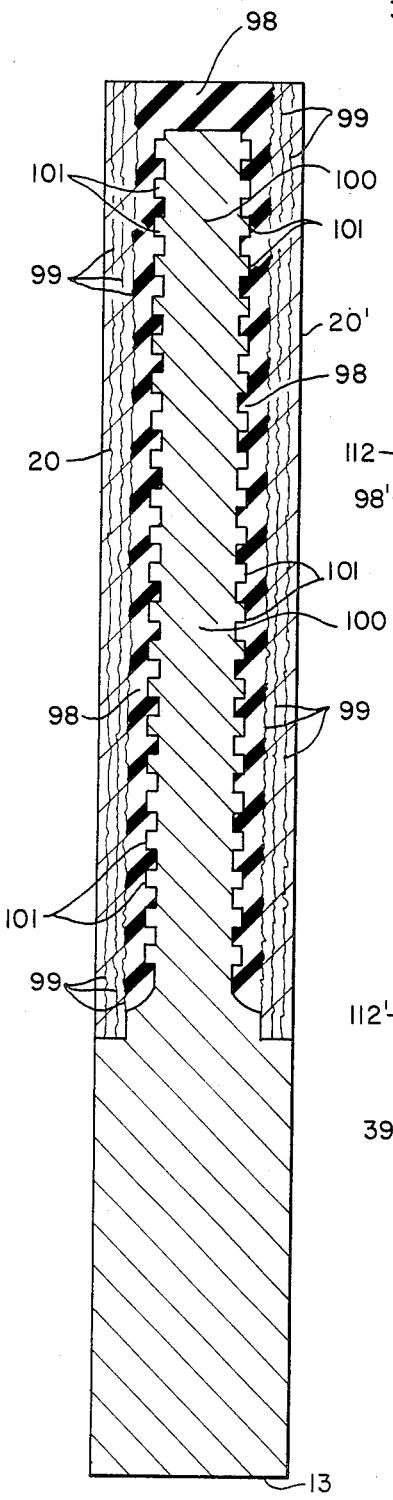
FIG. 9 is a cross section of a ram, on an enlarged scale and taken along line 9—9 of FIG. 4.

As in FIG. 9, the sides 20 and 20' of the ram R, which are engaged by the flywheels, are composed of a suitable plastic 98, such as polyurethane, in which layers 99 of woven natural fibers, such as long fiber cotton, are embedded. On each side, fiber layers 99 are cut to shape and placed in position while alternate layers of polyurethane are deposited thereon, so as to form a composite structure. The polyurethane may be applied in liquid or semi-liquid form, within a mold which forms the end edges of the ram and successive fiber layers are placed within the mold as soon as sufficient plastic is deposited to cover the preceding fiber layer. Thus, the fiber layers 99 are preferably relatively close together, but separated by plastic. This combination of woven layers of natural fibers and appropriate plastic has resulted in a ram life of hundreds or perhaps thousands of multiples of the life of other materials or mixtures. Such layers are, of course, disclosed in my copending application Ser. No. 407,089, which also sets forth some 12 examples ions of materials which had been tried and found wanting. The center of the ram, above the striking head 13, may comprise a stem 100 formed of the same material as the head, such as a high strength, high impact resistance alloy steel, such as 4140 steel. Other steels may, of course, be found suitable. The stem 100 is provided, on each side, with a series of transverse ribs 101, extending from one side to the other of the stem and spaced apart a distance corresponding to the thickness of the ribs, although these dimensions may be varied. The plastic 98, which is embedded between the steel ribs 101, provides a secure anchor against the forces imposed on the ram by the thrust of the high speed flywheels as they engage the respective sides of the ram. When the ribs 101 extend transversely of the stem, as shown, a greater resistance to loosening of the plastic on the stem is produced, than if the ribs extended longitudinally, i.e. in the same direction as the thrust of the flywheels on the ram. It is also much preferred that the stem 100 be internal with the head 13 of the ram, in order to permit several thousands or hundred thousands strokes of the ram without any failure.

Figure 10:
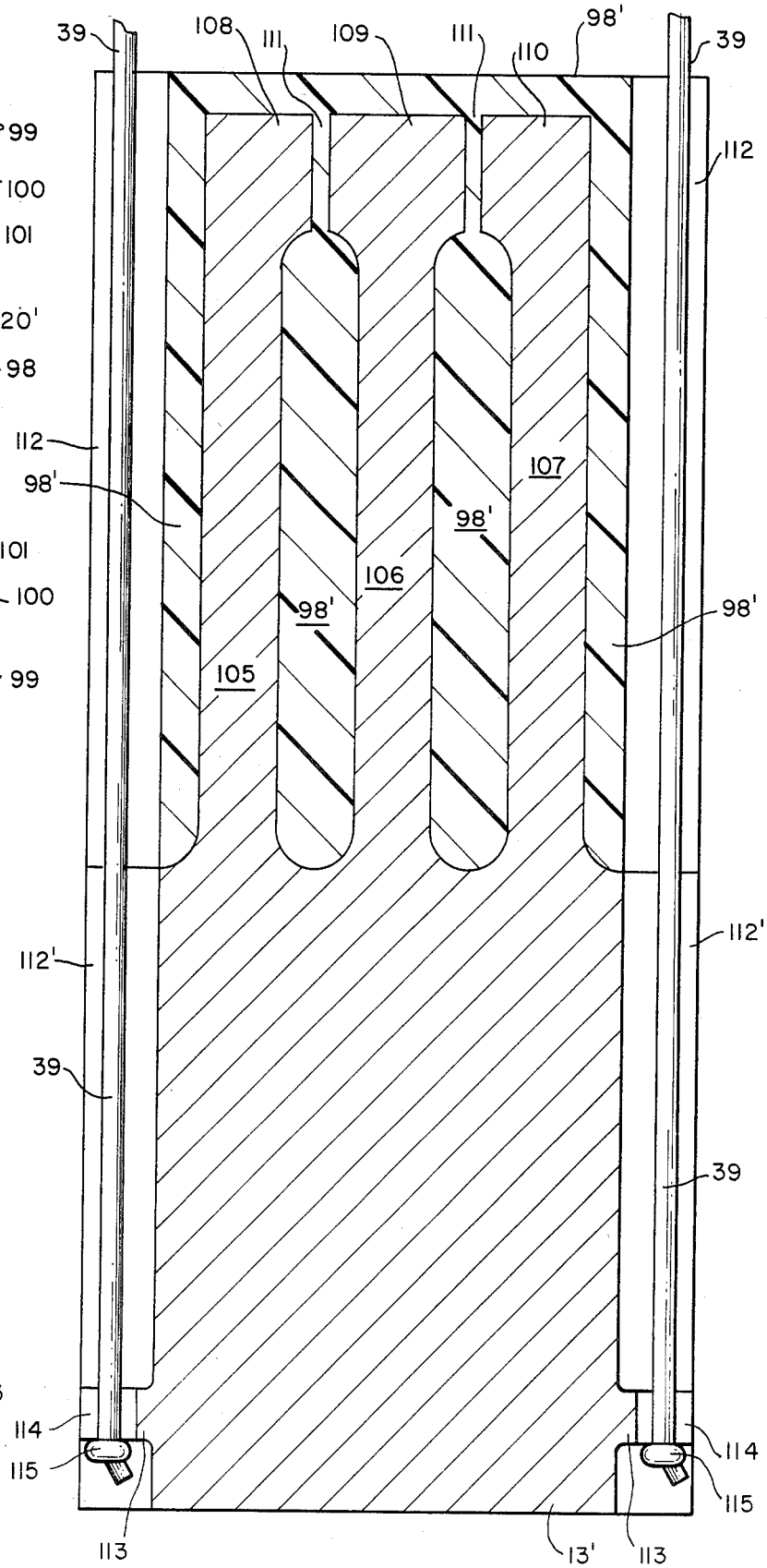
FIG. 10 is a lateral vertical section of an alternative ram construction.

The ram illustrated in FIG. 10 is a variation of that illustrated in FIG. 9, although some of the features of either may be utilized in the other. In the case of the ram of FIG. 10, a head 13' is provided with a series of longitudinal stems 105, 106 and 107. Between the head 13' and the upper end of each stem, the stems are spaced apart, such as a distance approximately equal to the width of the stems. However, at the upper end of each stem, an enlargement is provided, such as enlargement 108, on stem 105, which extends laterally toward the center. On the upper end of stem 106, an enlargement 109 extends to each side of the stem, while at the upper end of stem 107 an enlargement 110 extends toward the center, being essentially a mirror image of enlargement 108 of stem 105. A gap 111 between the enlargements 108, 109 and 109, 110 is a fraction of the space between the stems, but does connect the plastic 98' between the stems with the plastic above the enlargements, thereby tending to attach the plastic 98' more securely to the stems. In the embodiment of FIG. 10, the stems 105, 106 and 107 may be provided on their sides with transverse ribs corresponding to ribs 101 of FIG. 9, although the locking of the plastic to the stems through the enlargements 108, 109 and 110 may be found to be sufficient to resist the stresses imposed by the propulsion of the ram by the flywheels. The sides of the ram of FIG. 10 are, of course, provided with woven natural fiber layers embedded in plastic, such as in FIG. 9. A pair of bungee cords 39 may extend downwardly, adjacent each edge of the ram, within a slot 112 in the plastic 98' and an aligned slot 112' in the metal of head 13'. Adjacent the lower end of the head, a rib 113 extends across the slot 112', being provided with a narrow longitudinal slot 114 which receives the corresponding cord 39, with rib 113 preventing upward movement of either corresponding cord through a knot 115 tied in the cord below rib 113, or other suitable stop device. Such attachment causes the cord to be pulled down as the ram is driven downwardly by the flywheels and pulls the ram back up after the ram has struck a tool, such as tool T or tool T' and expended its energy.

Figure 11:
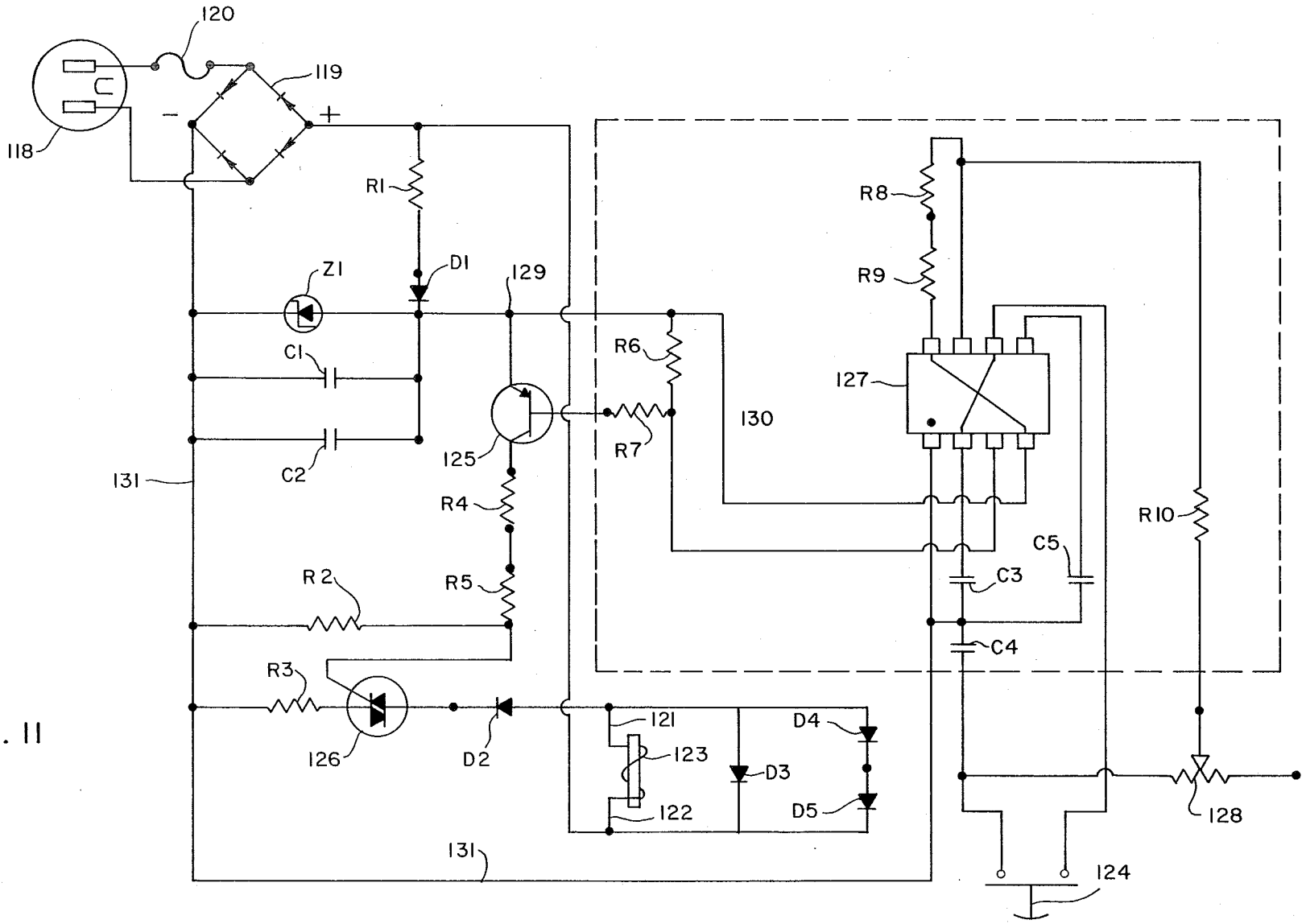
FIG. 11 is a diagram of an electronic circuit for controlling the movement of the flywheels toward and away from the ram on its path.

The control circuit of FIG. 11 includes a power supply plug 118 connected with a conventional diode rectifier 119 through a fuse 120 to supply activating current at pre-set times, through wires 121 and 122, to a solenoid coil 123, when a switch 124 is closed. Rectifier 119, which may consist of 1N 34 diodes, also protects the circuit against stray or reverse currents, such as produced by an alternator which may be used in charging the 12-volt battery of the vehicle, which may be utilized to supply the current for the control circuit, while fuse 120 may be a SLO-BLO 4D 2505 A. The circuit is essentially conventional and includes a transistor 125, such as an MJE 700, and a triac 126, such as an SC 45 D. The circuit also includes a wide range adjustable timer 127, such as an MC 1455 D1, models 601, 626 and 693 being suitable, with model 626 being shown, and a potentiometer 128, such as 10K, which may be set to control the time between activation and deactivation and vice-versa of solenoid 123. The timer may be set to cause triac 126 to become conductive for very short periods of time, such as seconds, as at intervals of seconds and continue to do so as long as switch 124 remains closed. The remaining components of the circuit include resistors $r_1$ through $r_{10}$, capacitors $c_1$ through $c_5$, diodes $d_1$ through $d_5$ and a Zener diode $z_1$. These parts have the designation set forth in the following Table I, Table II and Table III.

TABLE I

| RESISTORS | |
|---|---|
| $r_1$ | 8K, 25 W |
| $r_2$ | 2.2K, 0.5 W |
| $r_3$ | 2 ohm, 10 W |
| $r_4$ | 47 ohm, 0.5 W |
| $r_5$ | 47 ohm, 0.5 W |
| $r_6$ | 18K, 0.5 W |
| $r_7$ | 1K, 0.5 W |
| $r_8$ | 470K, 0.5 W |
| $r_9$ | 2.2K, 0.5 W |
| $r_{10}$ | 2K, 0.5 W |

TABLE II

| CAPACITORS | |
|---|---|
| $c_1$ | 100 f, 40 V DC |
| $c_2$ | 100 f, 40 V DC |
| $c_3$ | .01 f, 100 V DC |
| $c_4$ | 4 f, 200 V DC |
| $c_5$ | .01 f, 100 V DC |

TABLE III

| DIODES | |
|---|---|
| $d_1$ | 1 N 4003 |

TABLE III-continued

| DIODES | |
|---|---|
| $d_2$ | MR 502 |
| $d_3$ | 7937 |
| $d_4$ | IN 4003 |
| $d_5$ | IN 4003 |
| $Z_1$ | Z 1106 |

Full wave rectifier 119, resistor $r_1$, zener diode $Z_1$ and capacitors $c_1$ and $c_2$, together with diode $d_1$, function as a DC power supply. Thus, a DC voltage is applied to node 129 to bias transistor 125, as well as to supply current to the linear integrated circuit utilized as a timing circuit of timer 127, through lead 130. Full voltage is also supplied to timer 127 through a lead 131 which extends from rectifier 119 and also supplies current to triac 126 for energizing solenoid 123. Closure of switch causes activating current to be supplied to timer 127, while potentiometer 128, as indicated, functions to control the timing of the linear integrated circuit of timer 127. Application of base current to transistor 125 through resistor $r_7$ drives the transistor 125 to saturation to trigger the triac 126 through resistors $r_4$ and $r_5$. Thus, triac 126 activates solenoid 123 to cause the flywheels to engage the ram and drive it against tool T or T'.

Figure 12:
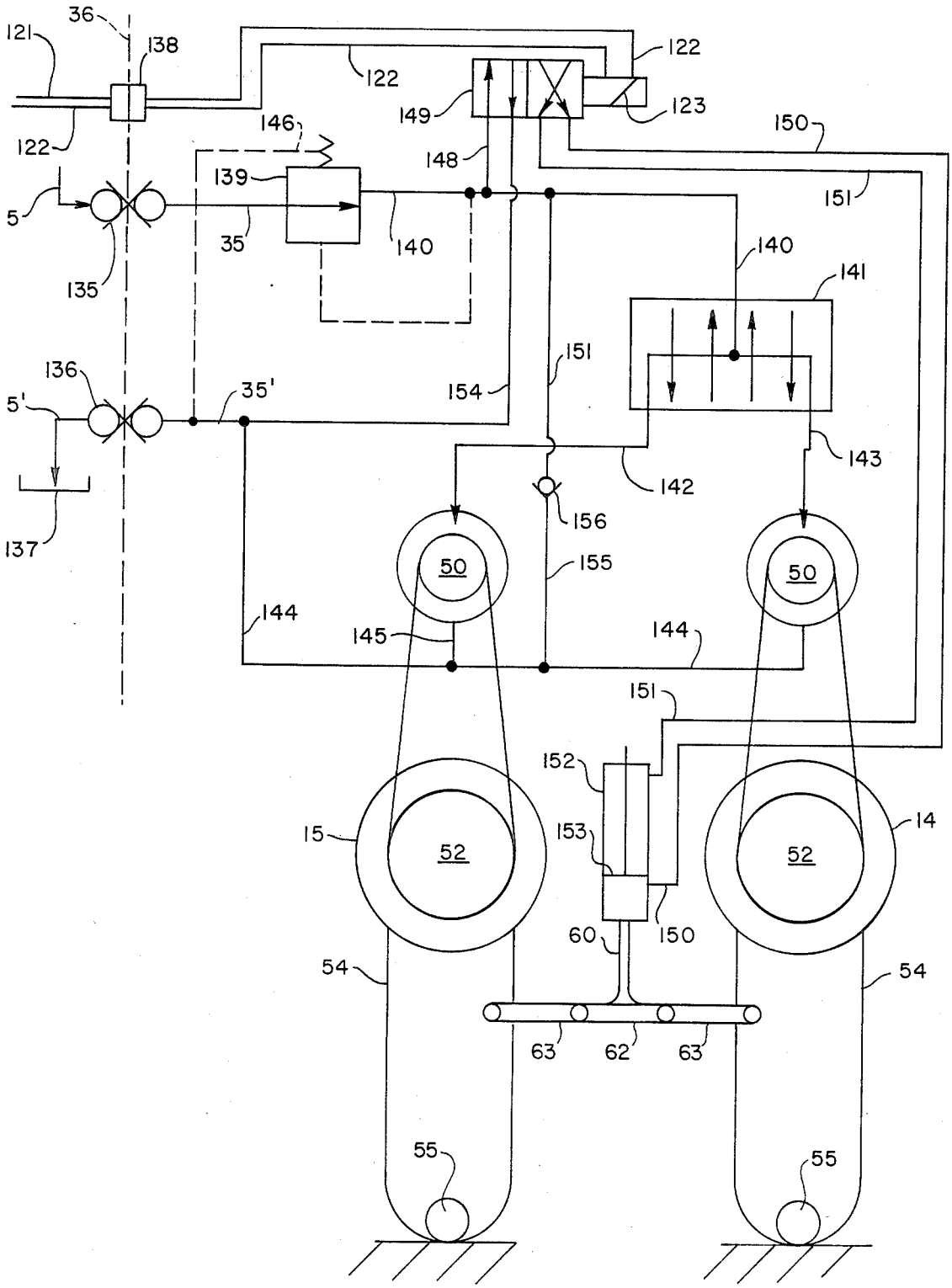
FIG. 12 is a diagram of a hydraulic circuit for supplying hydraulic fluid to the motors which rotate the flywheels and the cylinder and piston which produce the movement of the flywheels controlled by the circuit of FIG. 11.

The hydraulic circuit shown in FIG. 12 includes the inlet hose 35 of FIG. 1, which is supplied with hydraulic fluid by a conventional pump, such as driven by a power takeoff of the vehicle upon which the device is mounted. A quick release valve 135, which is utilized to disconnect the hydraulic inlet line when desired, is interposed in hose 35, while a similar quick release valve 136 is interposed in outlet hose 35', which extends to a reservoir 137. Electrical wires 121 and 122 of FIG. 11 supply electricity of a suitable voltage, such as 12 volts as indicated, to solenoid 123 for its operation, which is controlled by the circuit of FIG. 11. A disconnect plug 138 is connected in wires 121 and 122, while each of quick release valves 135 and 136 and disconnect plug 138 are placed at a wall of the unit, such as plate 36 of FIG. 1, indicated by dotted line 36 of FIG. 12. From the quick release valve 135, hose 35 connects with a pressure relief valve 139, from which a line 140 extends to a flow divider 141 for supplying fluid to the hydraulic motors 44. Thus, from the flow divider 141, one intake line 142 leads to one hydraulic motor 44 while another intake line 143 leads to the other hydraulic motor 44. As described previously, each hydraulic motor 44 rotates a pulley 50, each of which, as illustrated diagrammatically, is connected by a belt 51 with a pulley 52 driving the respective flywheel 14 or 15 and each of which is mounted on a pair of arms, including an arm 54, in turn pivoted on a bolt 55. Alternatively, the arms may be pivoted on pins corresponding to pivot pins 65 of FIGS. 6 and 7. From one motor 44, an outlet line 144, to which an outlet line 145 from the other motor 44 is connected, leads to return hose 35'. A discharge line, indicated by dotted line 146, extends from the outlet of pressure relief valve 139 to return hose 35'. A branch supply line 148 extends from line 140 to a 4-way, 2-position valve 149, which is actuated by solenoid 123. A pair of hydraulic fluid lines 150 and 151, such as hoses, lead from two outlets of valve 149 to a hydraulic cylinder 152 and are connected thereto on opposite sides of a piston 153, each line 150 and 151 supplying fluid to or removing fluid from opposite sides of the piston, or maintaining the position of the piston, depending on the position of valve 149. Piston 153 shifts the plunger 60, which is adjustably attached to connector 62, in turn pivotally connected by links 63 with the respective arms 54 on which flywheels 14 and 15 are mounted. Thus, when fluid under pressure is supplied through hose 150 from below piston 153, the piston is driven downwardly and plunger 60 is moved similarly to cause links 63 to move to a parallel position, as shown, i.e. with the lower portion of connector 62 aligned with the links, to shift the flywheels to a position away from the ram. Similarly, when fluid is supplied to cylinder 152 below piston 153 by hose 150 and removed by hose 151, piston 153 will be moved upwardly and also move plunger 60 upwardly, so that links 63 will pull the flywheels 14 and 15 inwardly and into engagement with the ram R, as of FIGS. 2, 4, 5, 6 or 7. At the same time that fluid is supplied to cylinder 153 by hose 150 or 151, the fluid removed by the other line will be returned to 4-way valve 149, by which it will be diverted to a return line 154, connected to outlet hose 35', for flow to reservoir 137. A relief line 155, connected between inlet line 140 and outlet line 144, is provided with a check valve 156, which causes excess pressure in inlet line 140 to be diverted to outlet line 144.

Figure 13:
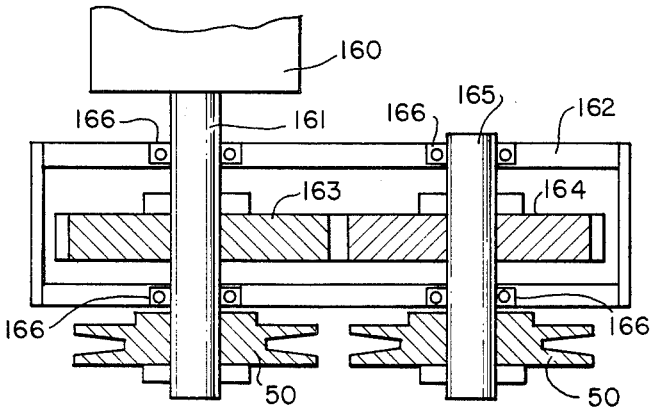
FIG. 13 is a fragmentary, centrally transverse section of an alternative drive arrangement, utilizing a single motor for driving the flywheels.

An optional single motor drive is illustrated in FIG. 13, in which a single hydraulic motor 160, similar to motors 44 of FIGS. 2 and 5 but larger, is adapted to drive both pulleys 50 in opposite directions. A first pulley 50, from which one flywheel is driven, is mounted on the outer end of a shaft 161 driven by motor 160; this shaft extends through a gear housing 162, in which a high speed gear 163 is mounted on shaft 161, for engagement with an identical gear 164 which, in turn, is mounted on a countershaft 165, on the outer end of which the second pulley 50 is mounted. A series of bearings 166, such as two for each shaft 161 and 165, are mounted in housing 162. Since gears 163 and 164, through engaggement, will rotate at the same speed but in opposite directions, counter shaft 165, as well as second pulley 50 from which the opposite flywheel is driven, will be rotated in a direction opposite to the first pulley. The result will be that the flywheels 14 and 15 will be driven in opposite directions, at the same speed, from a single motor. Motor 160 and gear housing 162 may be mounted in a position corresponding to motor 44 of FIG. 5 or 44' of FIG. 6. The flywheels are slowed down through engagement with the ram and must accelerate to their original speed of rotation during the interval between disengagement with the ram as it moves downwardly and the next time the flywheels are to engage the ram to drive it downwardly. Solenoid 123 and valve 149 should be placed as close as possible to cylinder 152, such as directly alongside or incorporated with the cylinder, to minimize lag time between action of valve 123 and response of piston 153.

The second embodiment, as illustrated diagrammatically in FIG. 14, includes a pair of flywheels 14' and 15' mounted on opposite sides of a ram R, with each flywheel being driven by a hydraulic motor 44' through a pulley 50' and a belt 51' which engages a pulley for driving the respective flywheel in the manner described previously. This embodiment includes a spring 168 which is engaged by the ram R on its upward stroke, the ram dissipating its kinetic energy by compressing the spring, so that the bumping of the frame of the unit, when a bumper is utilized to stop the ram, is avoided. In addition, the energy imparted by the ram to the spring is, in general, returned to the ram to start the ram on its next downward move. This produces a downward movement of the ram so that when the flywheels engage the ram, the ram is already moving, rather than being stationary when initially engaged by the flywheels. Thus, there is less opportunity for the flywheels to "dig into" the ram, as well as an enhanced opportunity for the flywheels to accelerate the ram to its desired speed. Spring 168 is suspended from an upper plate 169, the upper end of the spring being attached within a cup 170 and the lower end of the spring being attached to a base 171 which maintains the lower end of the spring in position through the same guides 172 and 173 which guide the ram. Flywheel 14' may be movable toward and away from the ram and flywheel 15' maintained in a fixed position, in order to reduce the amount of force required to move the flywheels into engagement with the ram. Thus, flywheel 14' may be supported by a mount M pivoted at its upper end on a pin 174. The flywheel 14' is moved toward and away from the ram by a double-acting hydraulic cylinder 175 having a piston rod 176 connected to the lower end of the mount M.

This embodiment includes an upper ram proximity sensor $S_1$ located at a position, such as below the lower end of the spring, for actuation when the ram moves upwardly to this position, in order to actuate the control for the hydraulic cylinder 175, as as to cause flywheel 14' to be moved toward the ram for engagement therewith at an appropriate time. The position of the proximity sensor $S_1$ is correlated with the time lag after actuation of a solenoid which controls the flow through a valve to the hydraulic cylinder 175 and movement of the flywheel to a position engaging the ram, deducting the time required for the ram to compress spring 68 and return to a position at which the lower edge of the ram is slightly below the engaging surfaces of the flywheels.

The second embodiment also includes a lower ram proximity sensor $S_2$ of FIG. 15 which is placed adjacent one side of the path of the ram, conveniently on the same side as the fixed flywheel 14', where there is additional space to accommodate the sensor. Sensor $S_2$ is positioned, such as opposite or slightly above the hydraulic cylinder 175, so that it will produce an actuating signal for reversal of the piston in the hydraulic cylinder 175 when the lower edge of the ram passes the sensor on its way down, with a consequent movement of the flywheel 14' away from the ram position, before the ram moves up again. Thus, the position of sensor $S_2$ is correlated with the time delay in moving the flywheel 14' away from the path of the ram, deducting the time required by the ram to strike the tool T'' and to be returned by the bungee cords, to be described later, to the position of the flywheels. It will be noted that the ram should weigh more than the tool, to minimize a rebounding effect when the ram strikes the tool, while the flywheels are driven continuously. During the time of engagement with the ram, the speed of each flywheel will be slowed, although during the return stroke of the ram and also during the time required for the ram to compress the spring and return of the ram by the spring for its down stroke, the flywheels will have an opportunity to regain their maximum speed of rotation.

The mounting plate 169 for the spring 168 is removably attached to a top plate 177 from which a pair of heavy lifting plates 178 extend upwardly. Plates 178 conveniently have the configuration shown in FIG. 14, so that a lifting beam may be attached to a front hole 179 and a tipping rod operated by a hydraulic cylinder, for instance, attached to a rear hole 179', for the purpose of tipping the unit to different angular positions, primarily so that the unit may be maintained in an upright position when raised or lowered by the lifting beam to different elevations.

Each hydraulic motor 44' may be enclosed within a housing 180 to prevent hydraulic fluid from leaking from the motor onto the ram. The presence of oil on the ram will usually decrease the coefficient of friction and thereby reduce the amount of energy which may be transferred from a flywheel to the ram. The flywheel 14' may be supported by a pair of arms 181 and 182 pivoted on the pin 174, surrounded by a tube 183. A rod 184 extends between the lower ends of the arms, at the center of which piston rod 176 may be pivotally attached. Flywheel shaft 53', on one end of which a pulley 52' is mounted, is, in turn, mounted for rotation in bearings 185 attached to the respective arms 181 and 182. The closed sides of the upper and intermediate housings are provided by plates 186 and 187, while the sides of a barrel for the tool are closed by slanting plates 188 and 189, which extend downwardly to the lower edge of a lower reinforcing enclosure 190 through which a guide 191 for the tool extends. The lower end of guide tube 191 is provided with a wear plate 192. The inside of guide tube 191 corresponds to the normal diameter portion 193 of the tool, below which an enlarged portion 194 forms a ledge, for a purpose to be described later. At the lower end of the tool T' is a central projection 195, such as having a thickness corresponding to one-half of its diameter, which may be greater than one-half the diameter of the normal portion 193, such as up to 83% of the latter diameter. Projection 195 is particularly adapted to be utilized in crushing reinforced concrete, the theory therefor being explained later. A ring 196, which is slidable upwardly and downwardly along the portion 193 of normal diameter, carries a pin 197 which extends upwardly through the reinforcing enclosure 190, for actuating a proximity switch adapted to prevent the flywheels from engaging the ram if the tool were merely hanging from the unit and a blow of the ram would merely produce a shock for the unit. A rubber bumper 198 is carried on the ring 196, so that if the unit is set down hard against a surface, the rubber bumper will absorb the shock, rather than the shock being transmitted directly to wear plate 192.

Figure 16:
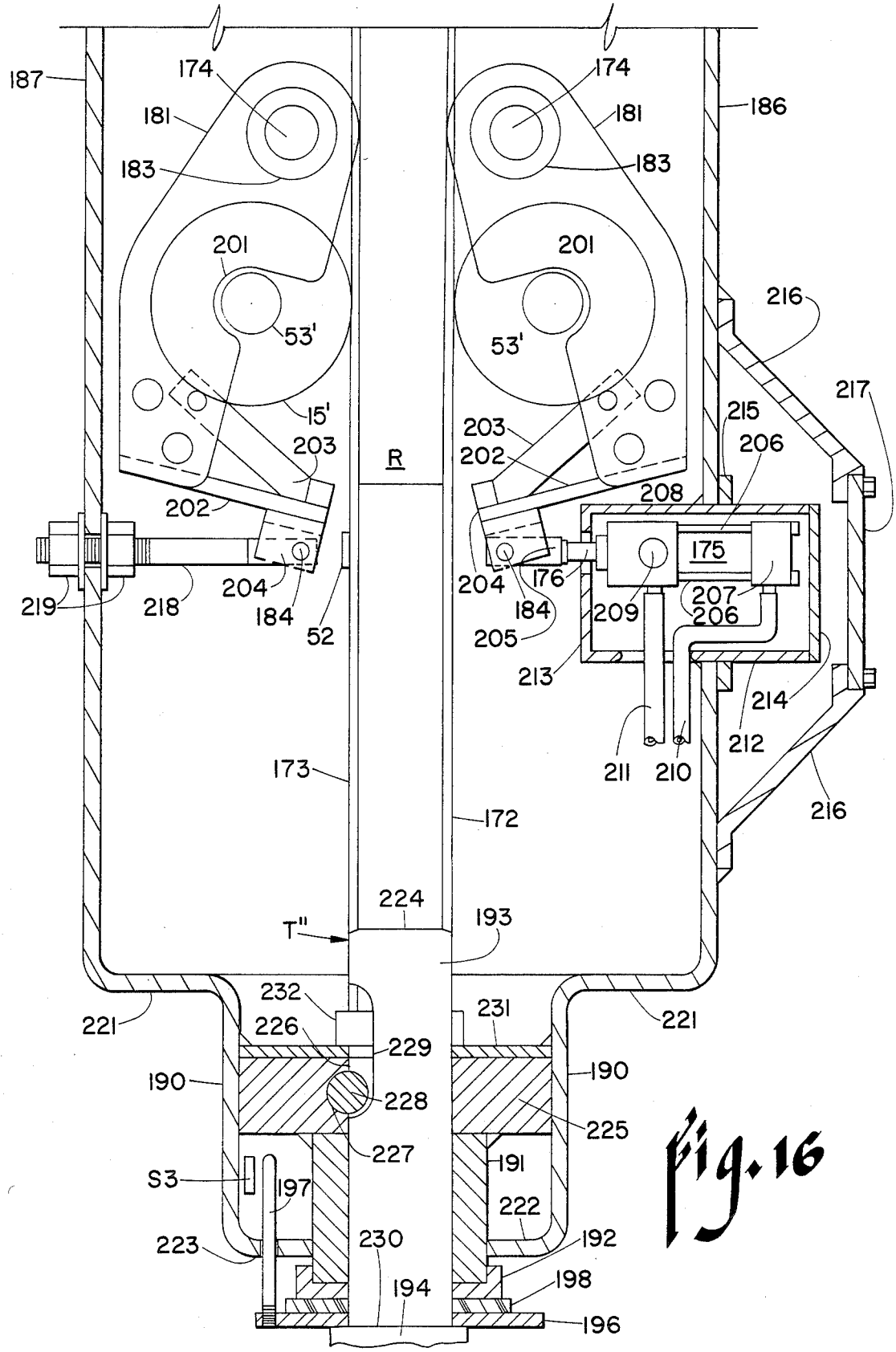
FIG. 16 is a partial vertical section, on an enlarged scale, corresponding to FIG. 14 but showing greater structural details of the flywheel mount and the tool guide as well as the sensor arrangement.

The preferred construction of the mounting for the flywheels and the parts within the barrel for the tool are shown in greater detail in FIG. 16, in which a tube 183 surrounds pivot pin 174 for flywheel 14' and arm 181 is provided with a notch 201 for accommodating the shaft 53' of flywheel 14', with the arm extending downwardly to a bar 202 at its lower end and a reinforcing angle 203 connected between arm 181 above its lower end and the extended end of bar 202. A bracket 204 extends downwardly from the extended end of bar 202 for receiving one end of rod 184. The opposite arm 182, shown in FIG. 15, is constructed in the same manner and provided with the same structure at its lower end, with rod 184 extending between bracket 204 of arm 181 and a corresponding bracket of arm 182. Piston rod 176, which extends from hydraulic cylinder 175, is provided at its outer end with an adjustable clevis 205 which pivotally engages rod 184. The hydraulic actuator for flywheel 14' includes a series of tension rods 206, such as four in number, spaced apart around the hydraulic cylinder 175 and extending between an outer block 207 and an inner block 208, with a pivot pin 209 extending laterally from each side of inner block 208. An hydraulic hose 210 extends from beneath to outer block 207 and a hydraulic hose 211 extends from beneath to inner block 208. Hydraulic cylinder 175 and parts associated therewith are enclosed within a housing which deters leakage of oil onto the ram and includes an open ended, box-shaped structure 212 having removable front and rear plates 213 and 214, respectively. The inner sides of the hollow structure 212 are provided with pivot bearings for the pivots 209 extending from opposite sides of block 208. Also, the front plate 213 is provided with a slot, as shown, to accommodate pivotal movement of piston rod 176, while the bottom of structure 212 with a hole, as shown, to accommodate hydraulic hoses 210 and 211. The enclosure for the hydraulic cylinder is mounted in and extends outwardly from wall 186, with positioning being assisted by a mounting ring 215. The hydraulic actuator is also protected by an outwardly inclined box 216 attached to side wall 186 and provided with a removable cover plate 217.

For convenience, the flywheel 15' may be mounted on a similar pair of arms 181 and 182 with each having parts corresponding to those of arm 181 for flywheel 14'. However, a bolt 218 pivotally engages rod 184 of the mounting for flywheel 15' and extends through side wall 187, being provided with nuts 219 on the inside and outside to adjust the position of flywheel 15'.

The lower end of each wall 186 and 187 may extend inwardly as a flange 221, which again may then extend downwardly to provide the lower enclosure 190. The latter may be provided at the bottom with inwardly extending flanges 222 and 223, the latter of which is provided with a hole, as shown, through which pin 197 may move. The respective flanges 221, 222 and 223, as well as the sides of enclosure 190, may be separate pieces attached together. Guide tube 191 may extend through flanges 222 and 223 to wear plate 192, the outer edges of which may extend upwardly around the guide tube, while rubber bumper 198 on ring 196 is shown in engagement with the wear plate 192, with the upper end 224 of tool T'' at the highest elevation permitted by the ring 196 and bumper 198, such as above flanges 221.

The normal diameter portion 193 of tool T'' extends upwardly to upper end 224 through the guide tube and a heavy block 225, which is provided with a central hole 226 which receives the tool, as well as a lateral hole 227 which intersects central hole 226 and receives a pin 228. Pin 228 extends laterally into an elongated slot 229 in the tool, which restricts movement of the tool T' for a distance corresponding to the slot length. The lower edge of slot 229 is preferably spaced slightly from pin 228 when rubber bumper 198 abuts wear plate 192, the position of ledge 230 at the upper end of enlarged portion 194 of the tool determining the distance which the tool can be moved upwardly. Since if the unit is moved downwardly by the machine handling it, and the tool abuts concrete to be broken up, for instance, rubber pad 198 is much more capable of taking the shock than slot 229 and the pin 228. A plate 231 may be mounted above block 225 to provide a support for a relatively thick rubber bumper 232, placed at each side of the tool, for engagement by the ram if the tool is driven or moves downwardly until the upper edge of the tool is below the upper edge of plate 231. As soon as the upper edge of slot 229 reaches pin 228, the tool will be stopped, although in this position, the upper edge of the tool will be below the upper edge of rubber bumper 232 for the ram.

Figure 17:
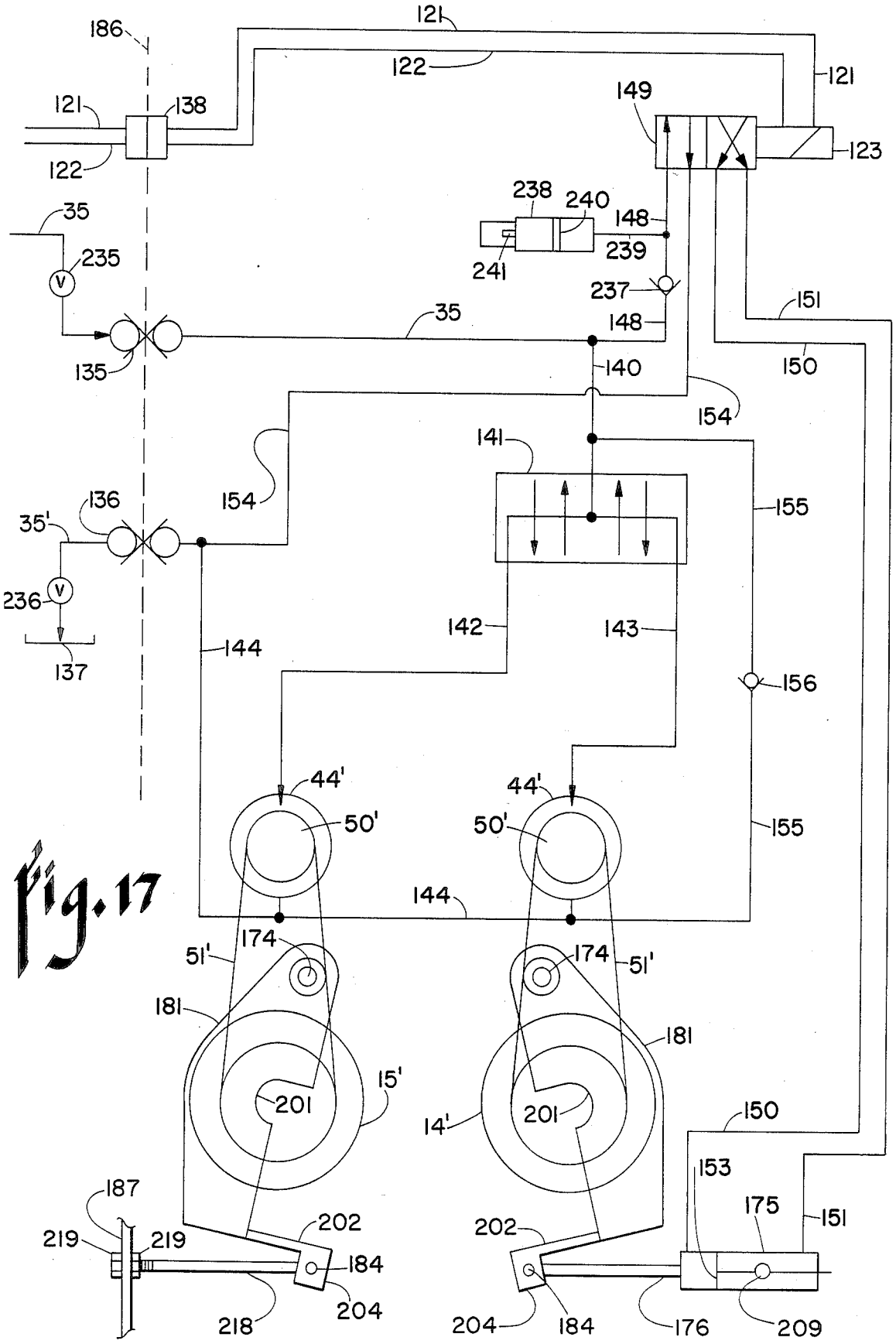
FIG. 17 is a diagram of the hydraulic circuit of the above embodiment.

The hydraulic diagram of FIG. 17 for the second embodiment is similar in many respects to the hydraulic diagram of FIG. 12 for the first embodiment, thus including a pair of wires 121 and 122 which extend through a disconnect plug 138 at wall 186 to supply current to a solenoid 123 for operating the valve 49 for controlling the flow through hydraulic lines 150 and 151, in this instance to the opposite ends of hydraulic cylinder 175, actually through the hoses 210 and 211 of FIG. 16. The hydraulic portion of FIG. 17 further includes an inlet hydraulic line 35 which extends through a disconnect valve 135 and an hydraulic outlet line 35' which extends through a disconnect valve 136 to a sump 137. In the present instance, a shutoff valve 235 is provided in inlet line 35 and a shutoff valve 236 in inlet line 35', so that the flow may be shut off before disconnecting the disconnect valves 135 and 136, respectively. Hydraulic fluid flows through inlet line 35 to a junction with an inlet line 140 for a flow divider 141 from which the hydraulic fluid is transferred through lines 142 and 143 to the respective hydraulic motors 44' with the discharge being through a line 144 to outlet line 35'. The various parts shown for the supports and for the flywheels 14' and 15', as well as the actuation of the flywheel 14', have reference numerals corresponding to those in FIG. 16. In the present instance, return line 155 is connected between outlet line 144 and inlet line 140, with a check valve 156 interposed, so that if movement of the ram is terminated for some reason, such as shifting the tool to a different position or the like, and the flywheels tend to drive the motors 44' as pumps which then discharge the hydraulic fluid into the return line 144 at a faster rate than desired, thereby producing a higher pressure in the outlet line, the higher pressure may be relieved by flow through line 155 and particularly check valve 156, so that the hydraulic fluid will merely circulate to the flow divider 141 and back to the hydraulic motors 44'.

Similar to the previous hydraulic system, a hydraulic line 148 connects with inlet line 35 to supply control valve 149, although in this instance, a check valve 237 is interposed in line 148 for cooperation with an accumulator 238 connected to line 148 by a branch line 239. Accumulator 238 is provided with a free piston 240 on one side of which the hydraulic fluid exerts pressure from branch line 239 and on the opposite side of which an inert gas exerts pressure. The cylinder of accumulator 238 may be pressurized with inert gas on the opposite side of piston 240 through a shielded pressure connection 241, such as prior to start of an operation and to a pressure equal to the maximum pressure expected in the line 148. During the period that the hydraulic cylinder is not supplied with fluid, i.e. both lines 150 and 151 are closed by valve 149, hydraulic fluid continues to be supplied through line 148. When the ram is returning and the flywheels are not engaged with the ram, the flywheels will recover their maximum speed and hydraulic pressure of the pump will rise to its maximum, such as 2000 pounds per square inch. This pressure will drive the piston 240 in a direction to compress the inert gas inserted through connection 241, until the gas is pressurized to a pressure equal to the maximum hydraulic pressure during such supply, since check valve 237 will prevent any hydraulic fluid from flowing back into line 35 or line 140. Thus, such maximum pressure in the accumulator is available to actuate the piston 153 in hydraulic cylinder 175, particularly when the flywheels have reached their maximum speed and the pump pressure falls because of a lower volume required by the hydraulic motors 44'. The action of accumulator 238 is, of course, taken into account in determining the time lag between the signal to solenoid 123 and the actual movement of the flywheel 14' into engagement with the ram.

Figure 18:
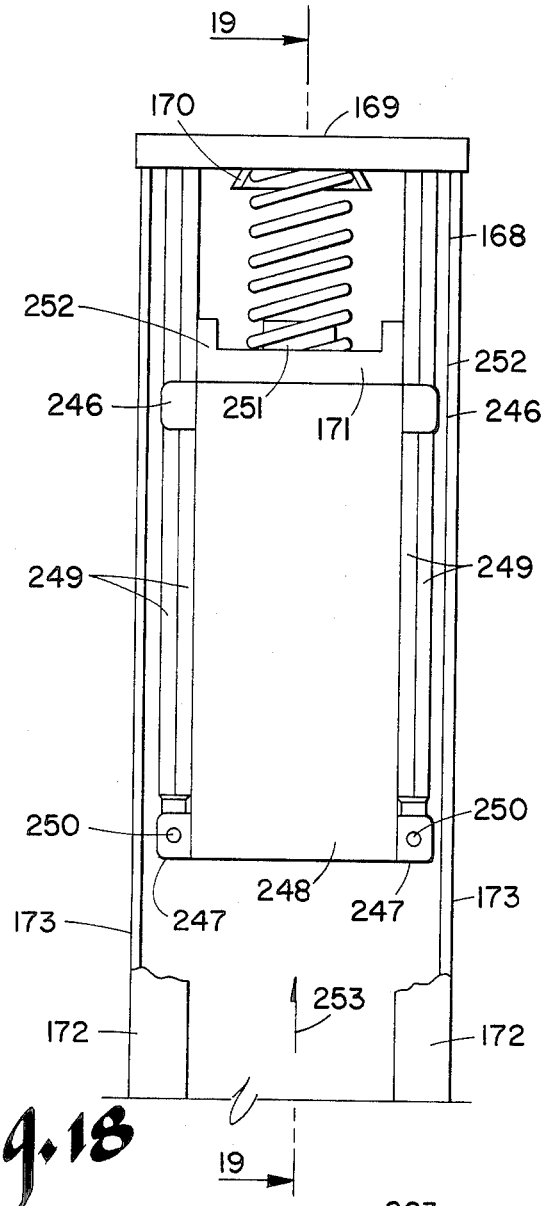
FIG. 18 is a side elevation in the same direction as FIG. 15 but on an enlarged scale and limited to the upper portion of the ram guides, showing particularly the spring compressed by the ram on its upward stroke.
Figure 19:
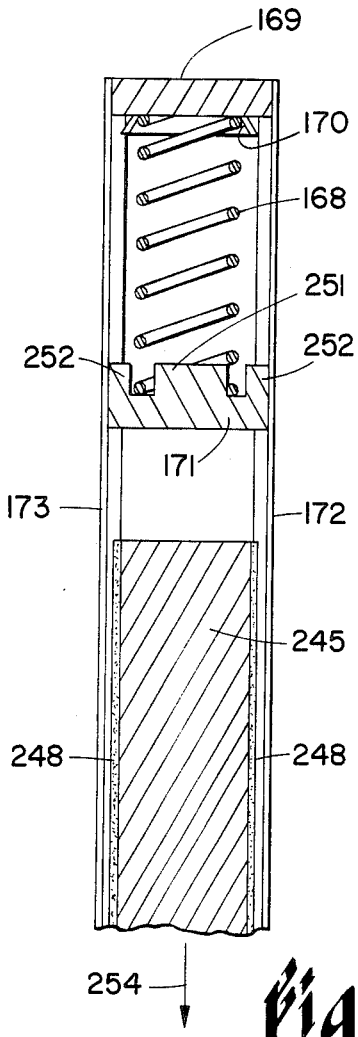
FIG. 19 is a transverse section, taken along line 19—19 of FIG. 18 but showing the spring extended after the ram is started on its downward stroke.

As in FIGS. 18 and 19, the ram R' is provided with a body 245 formed of metal, high in strength and in impact resistance, such as SAE 4140 steel, of which the tools may also be made. This body is provided with a set of integral, upper lateral ears 246 and a set of integrally lower lateral ears 247 at each of the corners at the upper and lower ends of the body. Both the body 245 and the friction layers 248 on opposite sides thereof, are spaced from the end flanges of the guides 172 and 173 to accommodate two pairs of bungee cords 249, which are doubled around a pin 250, which extend between each pair of bottom ears on each side and upwardly between upper ears 246 to the mounting plate 169. As indicated previously, the top of spring 168 is attached to a cup 170, in turn mounted on the underside of plate 169. The lower end of the spring is attached to base 171, as by clamps or the like on a cylindrical center projection 251, which corresponds in diameter to the inside of the spring. Each side of the spring base 171 extends outwardly for clearance from the end flanges of the ram guides 172 and 173, as an integral guide ear 252 at each side. In FIG. 18, the ram R' is shown by arrow 253 as having moved upwardly to compress the spring 168, which arrests the upward movement of the ram without subjecting the supportive structure to the impacts which would be produced by utilizing a rubber bumper at the top of the path of the ram. As indicated previously, the energy stored in the spring in compression, as in FIG. 18, is restored to the ram as the spring expands, as to the position in FIG. 19, in which the spring is extended and the ram is now moving downwardly, as indicated by arrow 254. The extended position of the spring, as in FIG. 19, corresponds fairly closely to the position of the spring when the spring and ram are at rest after the action of the flywheels has been discontinued and the ram is permitted to be held upwardly against the spring by the bungee cords 249.

Figure 20:
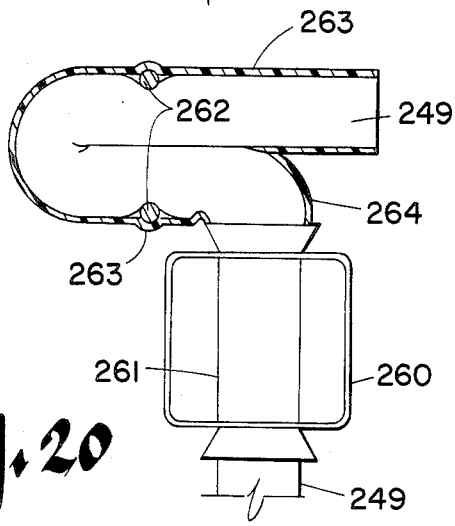
FIG. 20 is an end view, on an enlarged scale, showing particularly the manner in which each upper end of a resilient cord may be attached to a support.
Figure 21:
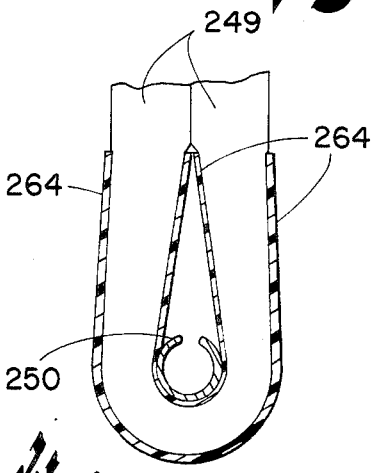
FIG. 21 is a fragmentary cross section, taken through a pin of the ram and around which a pair of resilient cords extend, illustrating the manner in which a cord may be held in place on the pin.

In FIG. 20 is illustrated a suitable manner for attachment of the ends of the bungee cords 249 at the top, such as above mounting plate 169. Such method is by utilizing a square tube 260 which extends laterally of the plate 170 and in which there are holes for four sections 260 of copper pipe, one for each end of the two bungee cords which are placed around pin 250 at the bottom of the ram, as described previously and shown in FIG. 24. Each end of each pipe is flared above and below the hollow square tube, so the ends of each bungee cord may be streched through the copper tube and clamped below the end, then a portion at the end is bent over, in the manner shown, while a metal clamping ring 262, such as a ring often referred to as a "hog ring", is placed thereon to maintain the end sections squeezed together. Then, a layer 263 of heat shrinkable plastic tubing is shrunk onto the projecting end as well as over the metal ring 262. A similar plastic cover 264 is shrunk over the portion of the cord which will extend into the tube 261. This connection not only enables the ends of the cords to resist a pulling force of high magnitude but also permits the cords to be pulled up and also permits the square tubing sections 260 to be removed with the mounting plate 170, along with the spring 168, its base 171 and the ram, for inspection, repair or the like. A similar heat shrinkable plastic cover 265, as in FIG. 21, may be shrunk around the lower end of each bungee cord, which is actually the center of the bungee cord folded around pin 250, so that the portion of the cord extending around the pin will be more wear resistant.

Figure 24:
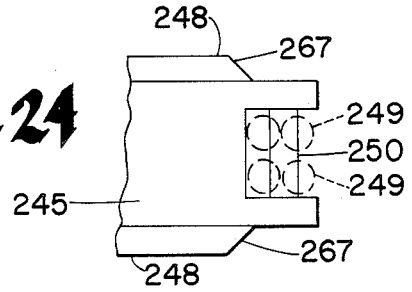
FIG. 24 is a fragmentary top plan view of the ram, showing the resilient cords in dotted lines.
Figure 22:
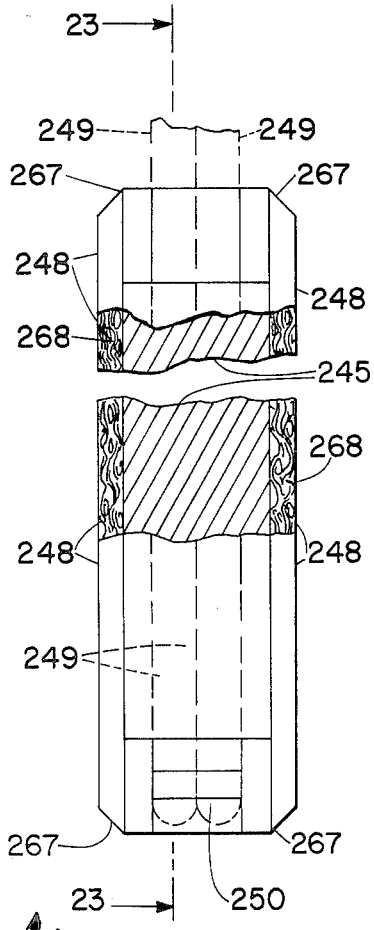
FIG. 22 is a condensed side elevation of the ram, broken away to show a section of the interior and also showing the resilient cords in dotted lines.
Figure 23:
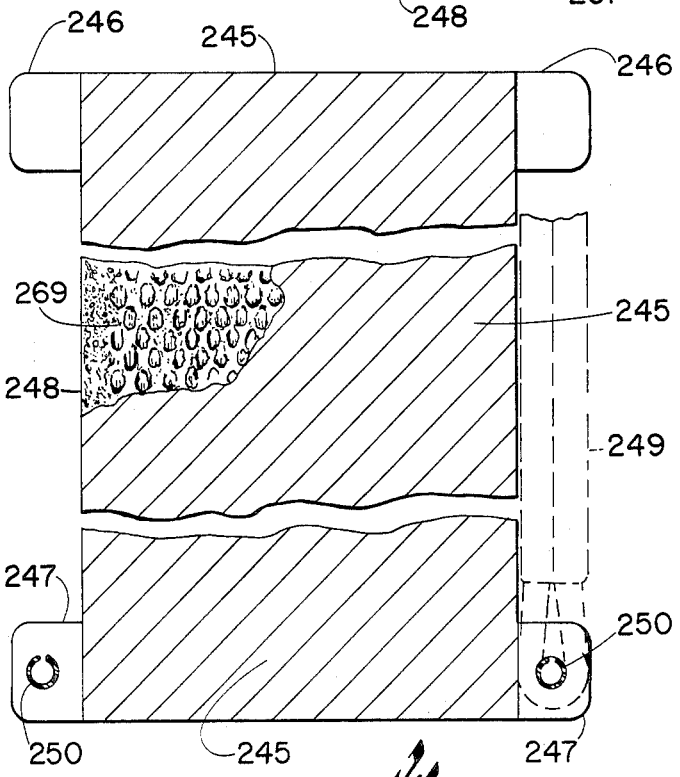
FIG. 23 is a condensed side elevation of the ram, taken along line 23—23 of FIG. 22 but with a portion thereof being a side view to show the visible appearance of the preferred friction material on the sides of the ram.

Additional details of the construction of the ram are shown in FIGS. 22–24, including the body 245 and the friction layers 248, as well as the bungee cords 249 and ears 246 and 247. As indicated previously, the body 245 is integral with the ears and occupies a central position between the friction layers 248, which are an improvement over a material produced by the additon of aluminum trihydrate, to long fiber cotton embedded in polyurethane, in turn an improvement over the previous layers formed long fiber cotton embeddded in polyurthane. The newest material is a trade secret product identified as a non-asbestos woven friction material, obtained from Texas Friction Material, Inc. of Magnolia, Tex., also indicated to include woven wire mesh and yarn impregnated with a thermal setting resin. This friction material is bonded to the metal body of the ram, on each side, by a polyurethane adhesive. Its edge, when cut, has an appearance similar to that shown in section in FIG. 22 as lines 268 indicating layers of wire mesh. However, on the outside, as shown in full in FIG. 23, a series 269 of interspaced oval configurations, somewhat representative of wire mesh, appear at various places.

The material obtained from Texas Friction Material, Inc. is relatively stiff and boardlike and provides a higher coefficient of friction with the bare metal of the flywheels, such as formed of the same SAE 4140 steel as the ram body and the tools. This material being described showed also an improvement in its resistance to heat, withstanding a temperature of 550° F. without deterioration, rather than 250° F., as for the best prior material.

In FIG. 24 are shown a pair of doubled bungee cords 249 extending upwardly between the upper ears 246, while in FIGS. 22 and 23 are shown a pair of bungee cords 249 bent around a pin 250 which extends between the lower ears 247, as described previously. Each friction layer 248 may be provided with a transverse bevel 267 at both its upper and lower ends. It will be noted that the lateral width of ears 246 and 247 is sufficient to extend between the side flanges of the ram guides 272 and 273, while the side flanges of the guides are slightly less in width than the ears so as to avoid engagement with the friction material.

Diagrams of the effect of the impact of a tool T″ of FIG. 15, or a variation thereof shown as tool T″ of FIG. 26, are shown in FIGS. 25 and 26. These figures illustrate the direction of the shattering forces produced by the impact of such tools on a reinforced concrete slab 273. In FIG. 25, the lower corner of the cylindrical lower extension 195 of the tool produces a diverging conical cleavage pattern when such lower edge impacts against the surface of the slab, represented by dotted lines 274. As the lower cylindrical projection 195 penetrates into the concrete, there will be a tendency for a fracture to extend along the cone, represented by dotted lines 274, although when a portion of the concrete has been demolished and the cylindrical extension 195 has been projected further into the slab, the cone represented by dotted lines 274 may be replaced by a somewhat lower cone. Also, when the cylindrical projection 195 has penetrated the concrete sufficiently that an impact of similar magnitude is produced by the circular lower corner of the enlarged portion 194 of the tool, similar fracture lines along a cone represented by dotted lines 275 will tend to be produced. Thus, when driven through a slab of concrete, such a tool tends to produce a similarly conical hole which is larger at the bottom than at the top. As a result, for the next series of blows to cause the tool to penetrate through the slab, a position spaced further from the initial position may be utilized, than if the tool merely produced a passage through the concrete of the same diameter as itself.

Figure 27:
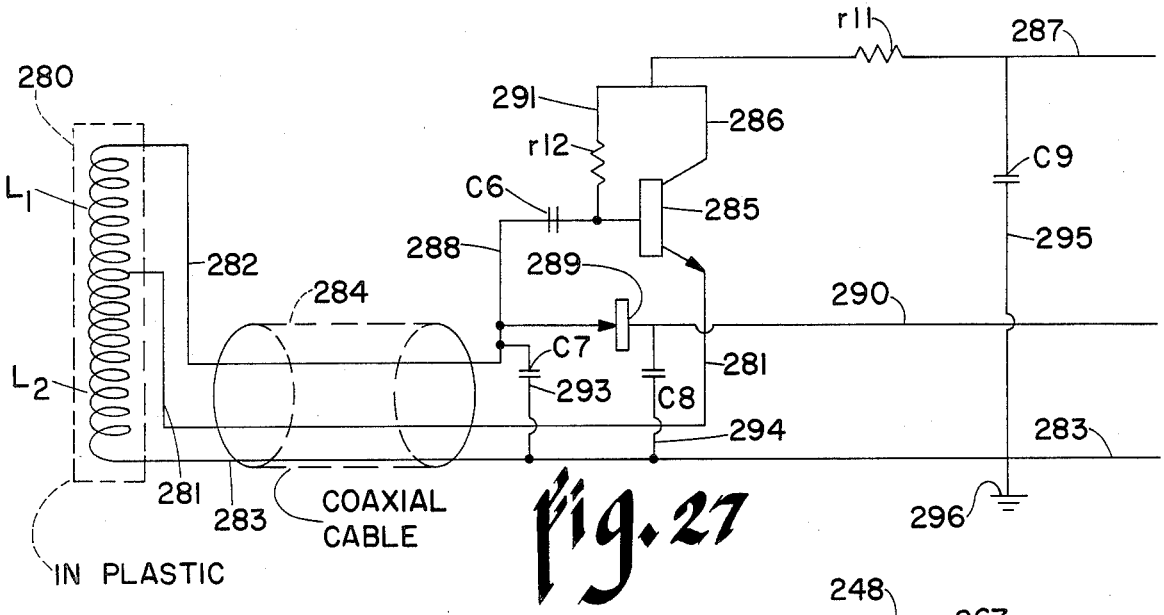
FIG. 27 is a circuit diagram for the proximity sensors utilized in detecting a desired position of an edge of the ram, or a pin which is carried by the tool.

The improved tool T‴ illustrated in FIG. 26 includes a central, lower cylindrical projection 195′ of greater diameter than the projection 195 of FIG. 25, surrounded above by a further enlarged cylindrical base 276 connected by a tapering surface 277 with the enlarged portion 194 which, of course, provides a ledge around its upper edge for carrying a ring, such as ring 195 of FIG. 15. Each tool T″ and T‴ are provided with a normal diameter portion 193 above enlarged portion 194. When the tool T‴ impacts against a slab 273 of concrete, the lower circular edge of lower projection 195′ will tend to produce a diverging shattering effect along a cone represented by dotted lines 274′, similar to tool T″. When the central projection 195′ has penetrated sufficiently that the lower circular edge of base 276 can be impacted against the surface of the slab 273, a shattering effect tends to be produced along the cone represented by the dotted lines 275″. Again, the tendency of this tool to produce a hole in the concrete which is larger at the bottom than at the top, permits the spacing between positions of impact to be increased than if the tool merely produced a hole through the concrete approximately its own diamter A suitable pair of coils and an associated circuit, for the sensors $S_1$, $S_2$ and $S_3$, are illustrated in FIG. 27. Each sensor is provided with a pair of coils $L_1$ and $L_2$ placed in a position in which the movement of metal near the coils will enable a signal to be produced. Such a signal can be used to control a valve which, in turn, controls the the movement of a flywheel 14′, or both flywheels if desired, toward the ram and away from the ram, respectively, or, in the case of sensor $S_3$, to prevent or retard actuation of the control valve if the tool is not in an appropriate position, i.e. pin 197 of FIG. 16 is not close enough to the sensor to actuate it. The coils $L_1$ and $L_2$ of the respective sensors are similar but differ in number of turns and sizes of wire used, as shown by the following Table IV.

TABLE IV

| | | SENSOR COILS | |
|---|---|---|---|
| Sensor | Coil | No. Turns | Wire Size |
| $S_1$ | $L_1$ | 45 | No. 24 |
| | $L_2$ | 15 | No. 14 |
| $S_2$ | $L_1$ | 55 | No. 24 |
| | $L_2$ | 18 | No. 14 |
| $S_3$ | $L_1$ | 15 | No. 20 |
| | $L_2$ | 45 | No. 24 |

The coils $L_1$ and $L_2$ are embedded in plastic 280, as indicated by dotted lines. A wire 281 extends from a position between the two coils while a wire 282 extends from the opposite end of coil $L_1$ and a wire 283 from the opposite end of coil $L_2$. These three wires extend through a coaxial cable 284, as indicated, to the remainder of the circuit, which is a one transistor oscillator circuit with feedback to the emitter and is also self temperature regulating. Thus, wire 281 connects with the emitter of an NPN silicon transistor 286, such as model 2N 2228A, while the collector is connected by a wire 286 with a positive lead wire 287, in which a resistor $r_{11}$ is interposed. Also, coil wire 282 is connected by a wire 288 to the base of transistor 285, through an impedance coupling capacitor $C_6$, while wire 282 is also connected to the base of a silicon diode 288, in turn connected to a signal wire 290. Wire 290 extends to the control circuit while wire 283 serves as the negative lead. A wire 291, in which a resistor $r_{12}$ is interposed, connects the base of transistor 285 with the junction of wires 286 and 287. A wire 293 interposes a capacitor $C_7$ between wire 284 and negative lead 283 to provide a resonance or tank circuit, while a wire 294 interposes a rectifying capacitor $C_8$ between wires 283 and 289. In addition, a wire 295 interposes a filter capacitor $C_9$ between positive supply wire 287 and a ground 276. The values of the capacitors and resistors referred to above are shown below in Table V and Table VI, respectively.

TABLE V

| CAPACITORS - SENSOR CIRCUIT | |
|---|---|
| $C_6$ | 20 pf |
| $C_7$ | 220 pf |
| $C_8$ | 0.01 pf |
| $C_9$ | 0.1 pf |

TABLE VI

| RESISTORS - SENSOR CIRCUIT | |
|---|---|
| $r_{11}$ | 390 ohms |
| $r_{12}$ | 100K |

The plastic encasement 280 for the coils is placed at the positions indicated for sensors $S_1$ and $S_2$ in FIGS. 14 and 15 and for sensor $S_3$ in FIG. 16. The remainder of the sensor circuit is placed in a position protected against shock, such as within foam rubber in a cardboard tube or the like.

Figure 28:
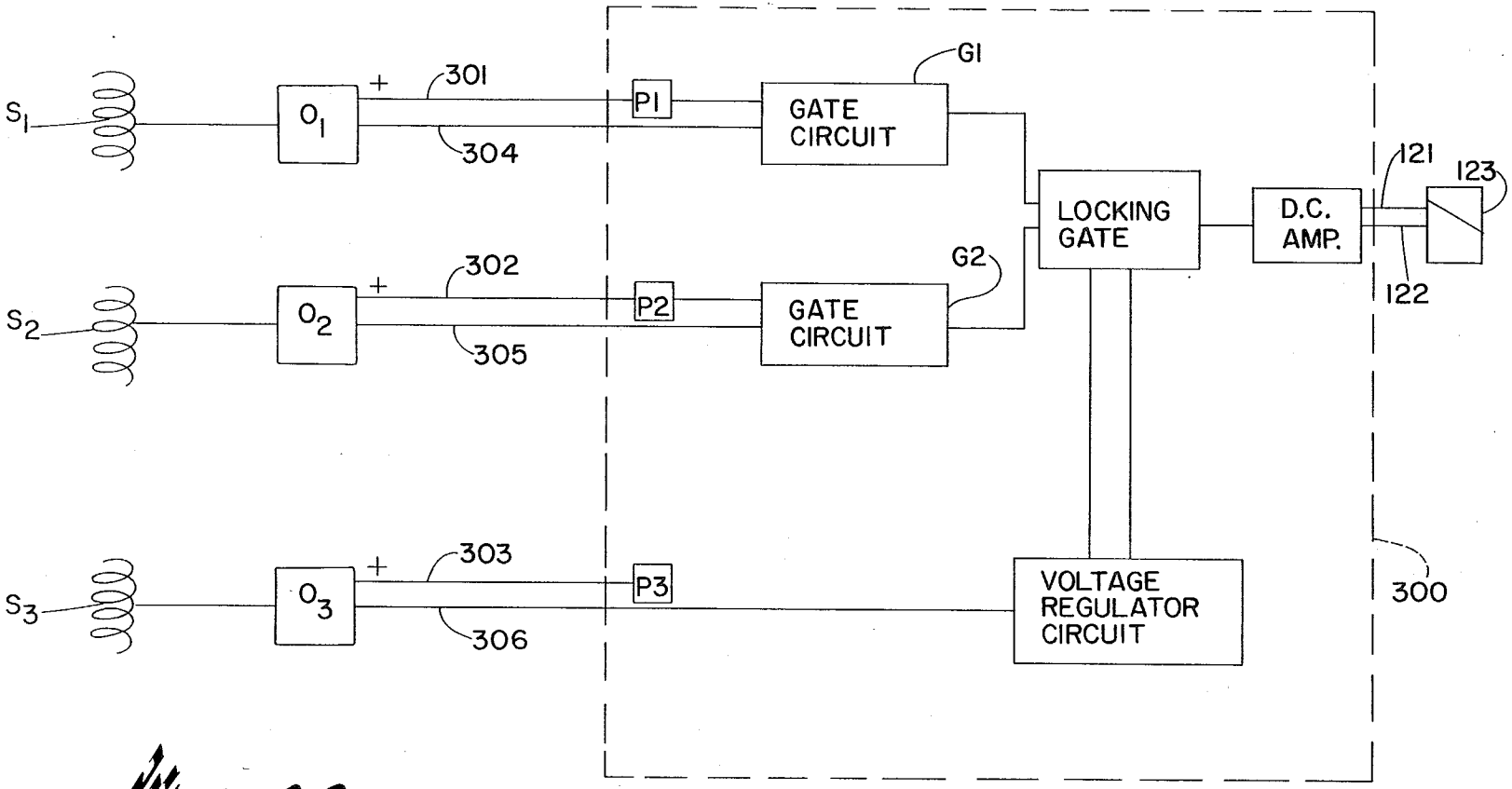
FIG. 28 is a diagram showing the general parts of a control circuit which operates in conjunction with the respective sensors and their circuits.

The circuit shown in FIG. 28 is essentially a logic circuit which may be a combination of discrete components, together with integrated logic circuit gates. As described previously, the coil of each sensor $S_1$, $S_2$ and $S_3$ is associated with an oscillator circuit identified in FIG. 28 as oscillators $O_1$, $O_2$ and $O_3$. It is noted that a potentiometer $P_1$ is placed in the positive lead 301 for the oscillator $O_1$, which connects with wire 287 of the circuit of FIG. 27, while a similar potentiometer $P_2$ is placed in a positive lead 302 for the oscillator $O_2$ and potentiometer $P_3$ is similarly connected in a positive lead 303 for the oscillation $O_3$. A signal wire 304 for oscillator $O_1$ of FIG. 28 corresponds to signal wire 290 of the oscillator circuit of FIG. 27, to which a signal wire 305 of oscillator $O_2$ and a signal wire 306 of oscillator $O_3$ also correspond. In FIG. 28, signal wire 304 leads to a gate circuit $G_1$, signal wire 305 to a gate circuit $G_2$ and signal wire 306 to a voltage regulation circuit, as indicated in FIG. 28. The two gate circuits $G_1$ and $G_2$ feed into a locking gate circuit, identified as such, which feeds into a D. C. amp or direct current amplifier. The latter, in turn, produces the actuating current over wires 121 and 122 to control solenoid 123, shown also in FIG. 17.

The operation of the above circuit is essentially that when oscillator $O_1$ has a low response, i.e. the metal of the ram is closely adjacent sensor $S_1$, it turns gate $G_1$ on, but at the same time, oscillator $O_2$ is high, since the ram has moved past sensor $S_2$ on the way up and the length of the ram is less than the distance between sensor $S_1$ and sensor $S_2$. As a result, the D. C. amp will cause the coil of solenoid 123 to be energized, thereby actuating the control valve to cause hydraulic fluid to be supplied to the piston which moves flywheel 14' toward the ram path. The lower end of the ram will have moved to below the flywheels when the flywheels engage the ram, thereby accelerating in its downward movement. When the ram leaves the top sensor $S_1$ but has not yet reached the ram sensor $S_2$, both oscillator $O_1$ and oscillator $O_2$ are high, so that the D. C. amp is locked on to maintain solenoid 123 in an energized position. However, when the lower end of the ram has reached sensor $S_2$, oscillator $O_1$ remains high but oscillator $O_2$ becomes low, which unlocks the D. C. amplifier and de-energizes the solenoid, so that its coil spring will reverse the solenoid valve and fluid will then be supplied to the opposite side of the piston, draining from the first side to which supplied, with the result that the flywheel 14' will be moved away from the path of the ram. As a result, the ram strikes the tool, such as a chisel, and is returned upwardly by the bungee cords without engaging the flywheels. As the ram passes sensor $S_1$, the actuation of the solenoid and the supply of hydraulic fluid to move the flywheel 14' toward the path of the ram is started again, although the flywheel does not engage the ram until the ram has compressed the upper spring, then stopped by the spring and started downwardly by the spring, so as to reach a position in which the lower end of the ram is again below the position of the flywheels. The action of sensor $S_3$, when the tool, such as a chisel, is not in an appropriate position to be struck by the ram, such as depending from the guide tube without engaging anything beneath, such as with the upper end of slot 229 of the tool engaging transverse pin 228 of FIG. 16. This means that pin 197 of FIG. 16 will be below sensor $S_3$, such as the upper end of pin 197 being in the hole in flange 223. As a result, the oscillator $O_3$ is high and causes the voltage regulator circuit to reduce the voltage supplied to the locking gate, so that it is insufficient to permit the D. C. amplifier to cause solenoid 123 to be energized, even though the ram is in an appropriate position.

It will be noted that at the start of an operation, when the ram is pulled up by the bungee cords 249 of FIG. 18, for instance, to the rest position, in which the bungee cords merely hold the ram against the underside of spring guide 171 and the spring is in approximately the same condition as in FIG. 19, the body of the ram will be opposite sensor $S_1$. Thus, if the hydraulic pumps have been started and the hydraulic motors have rotated the flywheels to a sufficient speed, the control circuits may be energized, with the result that, if the tool is merely suspended from the unit, the ram will not be actuated. However, if the unit is moved over a concrete slab, for instance, then downwardly toward the slab until the tool is moved to a position in which pin 197 of FIG. 16 is adjacent sensor $S_3$, then the operation will automatically start.

Although more than one preferred embodiment, as well as variation thereof, have been illustrated and described, it will be understood that other embodiments may exist and that various changes may be made therein, all without departing from the spirit and scope of this invention.

What is claimed is:

1. A method for reducing reverse shocks to rotating flywheel means of a device for producing movement of a ram toward a tool to produce a relatively heavy impact against said tool retained with said device after impact and wherein said ram is moved toward said tool through engagement of said ram by said rotating flywheel means, said method comprising:

causing said rotating flywheel means to engage said ram to drive said ram toward said tool;

discontinuing engagement of said flywheel means with said ram prior to said ram striking said tool; and arresting the movement of said ram beyond a predetermined position of movement of said tool when the resistance to movement of said tool is less than a predetermined amount.

2. A method for producing impacts against an object by a movable ram, comprising:

guiding said ram along a predetermined path;

positioning rotating means to engage and move said ram into an extended position effective to impact said object;

causing said ram to return to a retracted position from an impact against an object;

positioning said rotating means so as to avoid engagement with said ram while said ram is being returned to its retracted position; and controlling engagement of said rotating means with said ram for its movement into extended position in accordance with the movement of said ram to a predetermined retracted position following the previous impact against said object.

3. A method for producing impacts against an object by a movable ram, comprising:

guiding said ram along a predetermined path;

positioning rotating means to engage and move said ram into an extended position effective to impact said object;

causing said ram to return to a retracted position from an impact against said object;

positioning said rotating means so as to avoid engagement with said ram with said ram is being returned to its retracted position; and controlling positioning of said rotating means to avoid engagement with said ram during its movement into retracted position in accordance with the movement of said ram to a predetermiend extended position thereof during its previous movement against said object.

4. A device for producing blows of a tool, comprising:

a ram movable along a path;

means for guiding said ram along said path;

rotating flywheel means adapted to drive said ram into an extended position along said path through engagement with said ram;

means for supporting said flywheel means;

means associated with said supporting means for causing said flywheel means to engage with and disengaged from said ram;

means for placing said tool in the path of an end of said ram to be struck by said ram as the result of being driven by said flywheel means into exended position;

means for causing disengagement from said ram of said flywheel means prior to impact by said ram against said tool; and means for retaining said tool with said device after impact.

5. A device as defined in claim 4, wherein:

said ram is so positioned and proportioined that said flywheel means will, with said ram in a retracted position, engage at least one side of said ram at a position spaced from said end thereof.

6. A device as defined in claim 4, including:

resilient means for returning said ram, after an impact, to its retracted position.

7. A device as defined in claim 4, including:

spring means positioned to be struck by said ram upon its movement into retracted position thereby absorbing energy therefrom effective to reverse its direction and reposition same for engagement by said flywheel means.

8. A device as defined in claim 6, including:

means including a first sensor positioned and adapted to be engaged by said ram positioned and adapted to be engaged by said ram as it moves into retracted position following disengagement thereof by said flywheel means for controlling positioning of the latter for engagement with said ram, said first sensor means being operative to move said flywheel means into engagement with said ram as it moves into extended position; and means including a second sensor positioned and adapted to be engaged by said ram as it moves into extended position following engagement by said flywheel means for controlling positioning of the latter so as to avoid engagement with said ram, said second sensor means being operative to disengage said flywheel means from said ram as it moves into retracted position.

9. A device for producing impacts of a movable ram against an object, comprising:

means for guiding said ram along a predetermined path;

rotating means engageable with said ram for moving said ram into an extended position effective to impact said object;

means for moving said ram into a retracted position following an impact against said said object;

means for positioning said rotating means into position to engage said ram and move it into extended position and for positioning said rotating means so as to avoid engagement with said ram while the latter is returning to its retracted position;

means for controlling position of said rotating means for engagement with said ram on the next successive extension of said ram in accordance with the movemen tof said ram to a predetermined position of said ram during its movement into retracted position following an impact against said object.

10. A device for producing impacts of a movable ram against an object, comprising:

means for guiding said ram along a predetermined path;

rotating means engageable with said ram for moving said ram into an extended position effective to impact said object;

means for moving said ram into a retracted position following an impact against said object;

means for positioning said rotating means into position to engage said ram and move it into extended position and for positioning said rotating means so as to avoid engagement with said ram the latter is returning to its retracted position; and means for controlling position of said rotating means to avoid engagement with said ram during its movement into retracted position in accordance with the movement of said ram to a predetermined extended position thereof during its next previous movement against said object.

11. A device for producing blows, comprising:

a ram movable along a path;

means for guiding said ram along said path;

rotating flywheel means adapted to drive said ram along said path through engagement with said ram;

means for supporting said flywheel means;

means associated with said supporting means for causing said flywheel means to engage with and disengage from said ram;

a tool adapted to deliver a blow placed in the path of said ram to be struck by said ram;

means for limiting movement of said tool in a direction to retract same to a position in which the end of said ram closest to said tool is spaced from the adjacent end of said tool a distance greater than the movement of said ram in a direction to extend same produced by said flywheel means on the next stroke of said ram; and means for causing disengagement from said ram of said flywheel means prior to impact by said ram against said tool.

12. A device as defined in claim 11, including:

a housing for said ram, said ram guiding means, said flywheel means, said means for supporting said flywheel means, said means for rotating said flywheel means, and said means for causing said flywheel means to engage and disengage from said ram;

a housing for said tool containing said means for guiding said tool and said means for limiting movement of said tool; and said ram guiding means extending into said said tool housing.

13. A device as defined in claimed 12, wherein:

a portion of said tool housing is removably attached to permit removal and replacement of said tool.

14. A device as defined in claim 11, including:

resilient means for limiting movement of said tool in the event movement of said tool is not terminated by a blow delivered by said tool.

15. A device as defined in claim 11 including:

resilient rings mounted on said tool;

a stop engageable by said resilient rings provided by said guiding means;

a lateral enlargement integral with said tool and formed of shock-resistant metal; and a metal ring surrounding said tool above said resilient rings to receive the impact of said enlargement when the movement of said tool is terminated by said resilient rings.

16. A device as defined in claim 11, including:

a lateral enlargement on said tool; and a disc mounted in said tool housing above said lateral enlargement and provided with an aperture in which said tool is movable longitudinally, said aperture in said disc providing a stop engageable by said lateral enlargement to limit movement of said tool in a direction to retract same.

17. A device as defined in claim 11, wherein said guiding means for said tool is provided with a surface cooperative with a longitudinal surface on said tool to prevent rotation of said tool during use.

18. A device as defined in claim 11, including:

means for guiding said tool axially in its movement and for restraining movement of said tool beyond a predetermined position;

a member carried by and movable with said tool in the same direction as said tool; and means responsive to the position of said member forretarding positioning of said rotating means for engagement with said ram when said tool is at or adjacent a position in which said tool is supported only by said guiding means and by said means for restraining movement of said tool.

19. A device for producing blows comprising:

a ram movable along a longitudinal path;

means for guiding said ram along said path;

a pair of flywheels on opposite sides of said ram, so as to drive said ram along said path upon engagement with the respective sides of said ram;

means for supporting said flywheels for movement toward and away from said ram, including an arm extending at each side of each flywheel and pivoted about an axis spaced from said flywheel, said pivotal axis being parallel to the axis of rotation of said flywheel;

means associated with said supporting means for moving said flywheels toward and away from said ram;

an object placed in the path of said ram to be struck by said ram; and a torque resistant member extending between said arms at said pivotal axis of said arms for maintaining a parallel relation between the axis of rotation of each flywheel and the corresponding side of said ram.

20. A device as defined in claim 19, wherein:

said torque resistant member is tubular.

21. A device for producing impacts of a movable ram against a tool adapted to impact an object, said tool being retained with said device, comprising:

means for guiding said ram along a predetermined path;

rotating means engageable with said ram for moving said ram in a direction to impact said tool;

means for causing said ram to return from an impact against said tool;

means for positioning said rotating means so as to engage said ram to move said ram in a direction to impact said tool and for positioning said rotating means so as to avoid engagement with said ram while said ram is being returned from an impact against said tool;

means for guiding said tool axially in its movement and for restraining movement of said tool beyond a predetermined position;

a member carried by and movable with said tool in the same direction as said tool; and means responsive to the position of said member for retarding positioning of said rotating means for engagement with said ram when said tool is at or adjacent a position in which said tool is supported only by said guiding means and by said means for restraining movement of said tool.

* * * * *